US006314250B1

(12) United States Patent
Miyashiro

(10) Patent No.: US 6,314,250 B1
(45) Date of Patent: Nov. 6, 2001

(54) DEVELOPING DEVICE, PROCESS CARTRIDGE AND ELECTROPHOTOGRAPHIC IMAGE FORMING APPARATUS WITH CAPACITANCE DETECTOR FOR DETECTING RESIDUAL TONER AMOUNT

(75) Inventor: Toshiaki Miyashiro, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/577,872

(22) Filed: May 25, 2000

(30) Foreign Application Priority Data

May 27, 1999 (JP) ..... 11-148915

(51) Int. Cl.[7] ..... G03G 15/00; G03G 15/08
(52) U.S. Cl. ..... 399/27; 399/28
(58) Field of Search ..... 399/27, 28, 226; 340/617; 324/663; 73/304 C

(56) References Cited

U.S. PATENT DOCUMENTS 5,229,821 * 7/1993 Fujii ..... 399/28
5,987,269 * 11/1999 Allen et al. ..... 399/27

FOREIGN PATENT DOCUMENTS 55-50273 * 4/1980 (JP) .
4-285981 * 10/1992 (JP) .
8-286487 * 11/1996 (JP) .
11-184235 * 7/1999 (JP) .

* cited by examiner

*Primary Examiner*—Joan Pendegrass
(74) *Attorney, Agent, or Firm*—Fitzpatrick, Cella, Harper & Scinto

(57) ABSTRACT

A developing device mounted on a main body of an electrophotographic image forming apparatus and adapted to develop an electrostatic latent image formed on an electrophotographic photosensitive member, includes: a developer container including a developing portion with a developer bearing member for containing a developer therein and feeding the developer to the electrophotographic photosensitive member and a hopper for containing the developer therein and feeding the developer to the developing portion in order to develop the electrostatic latent image formed on the electrophotographic photosensitive member; and a developer residual amount detecting electrode pair having first and second electrodes disposed to interpose the developing portion and the hopper portion therebetween in order to detect the residual amount of developer by the main body of the electrophotographic image forming apparatus; wherein the first electrode of the developer residual amount detecting electrode pair comprises the developer bearing member, and the second electrode is fitted on an outer wall of the developer container.

22 Claims, 16 Drawing Sheets

SIGNALS WHEN SPATIAL AREA FORMED BETWEEN ELECTRODES IS SMALL

SIGNALS WHEN SPATIAL AREA FORMED BETWEEN ELECTRODES IS LARGE

50
SIGNAL OUTPUT TERMINAL
COMPARING CIRCUIT 55
R15
R14
CAPACITANCE DETECTING CIRCUIT 51
R7
R8
R6
C2
R5
R3
R4
24V
24V
R12
R13
R11
R10
R9
C3
D3
D5
D4
52 CAPACITANCE DETECTING CIRCUIT
Tr1
Tr2
R1
R2
R1'
R2'
R1''
R2''
R1'''
R2'''
SW
D2
D1
C1 10pF
BIAS POWER SUPPLY INPUT TERMINAL
REFERENCE CAPACITANCE CIRCUIT 53'
RECEIVED SIGNAL INPUT TERMINAL

DEVELOPING DEVICE, PROCESS CARTRIDGE AND ELECTROPHOTOGRAPHIC IMAGE FORMING APPARATUS WITH CAPACITANCE DETECTOR FOR DETECTING RESIDUAL TONER AMOUNT

BACKGROUND OF THE INVENTION

1. Field of the Invention

The present invention relates to an electrophotographic image forming apparatus that forms an electrostatic latent image on an electrophotographic photosensitive member through an electrophotographic process, and visualizes the electrostatic latent image with a developer contained in a developing device, and more particularly, to an electrophotographic image forming apparatus having developer amount detecting means capable of sequentially detecting the remaining amount of developer contained in a developer containing portion, a process cartridge and a developing device.

The electrophotographic image forming apparatus is directed to, for example, an electrophotographic copying machine, an electrophotographic printer such as an LED printer or a laser beam printer, an electrophotographic facsimile machine and an electrophotographic word processor.

The process cartridge makes at least one of charging means, developing means and cleaning means and an electrophotographic photosensitive member integrally into a cartridge that is detachably mountable to a main body of the electrophotographic image forming apparatus, or makes at least the developing means and the electrophotographic photosensitive member integrally into a cartridge that is detachably mountable to a main body of the electrophotographic image forming apparatus.

2. Related Background Art

Up to now, in an image forming apparatus using an electrophotographic image forming process, there has been applied a process cartridge system that makes the electrophotographic photosensitive member and process means that acts on the electrophotographic photosensitive member into a cartridge that is detachably mountable to a main body of the electrophotographic image forming apparatus. The process cartridge system can remarkably improve the operability, since the maintenance of the apparatus can be conducted by a user per se not depending on a service man. For that reason, the process cartridge system has been widely employed in the electrophotographic image forming apparatus.

One type of the electrophotographic image forming apparatuses of the above process cartridge system includes a developer amount presence and absence detecting device that informs the user of a fact that the developer has been completely consumed.

The details will be further described. FIG. 18 shows an example of an image forming apparatus A to which a conventional process cartridge B is mounted. A developing device 10 that constitutes developing means in the process cartridge B, includes a developer container 11 having a developing portion 13 that supplies a developer T to a latent image formed on a photosensitive drum 1 serving as an image bearing member to visualize the latent image and a hopper portion 14 provided for the purpose of reserving and storing the developer T. Then, the developer T within the hopper portion 14 is fed to the developing portion 13 from the interior of the hopper portion 14 by the gravity and an agitating device 15 or the other developer feeding means.

In the developing portion 13, a developing roller 12 that serves as a cylindrical developer bearing member for feeding the developer T up to a developing position opposite to the photosensitive drum 1 is disposed in the vicinity of the photosensitive drum 1. The developer T is stuck and held on the surface of the developing roller 12, and the developer T is fed up to the developing position opposite to the photosensitive drum 1 by the rotation of the developing roller 12.

The amount and height of the developer T are regulated and uniformly coated on the developing roller 12 by developer regulating means 17 such as a doctor blade while the developer T is being fed. The developer T is rubbed by the developing roller 12, the developer regulating means 17 or the developer T per se so that the developer T is charged during a process where the developer T is fed onto the developing roller 12.

Then, the developer T fed to a portion of the developing roller 12 opposite to the photosensitive drum 1 by the developing roller 12, that is, to a developing position, is transferred onto the photosensitive drum 1 by an appropriate developing bias voltage applied between the photosensitive drum 1 and the developing roller 12 by a developing bias power supply 54 that serves as bias applying means, and an electrostatic latent image on the photosensitive drum 1 is then developed to form a toner image.

The developer T that has not been used for development is fed while it remains on the developing roller 12, and then again contained in the developing portion 13.

On the other hand, a recording medium P set in a sheet feeding cassette 20 is conveyed to a transfer position by a pickup roller 21 and conveying means 22 having a conveying roller pair, a registration roller (not shown) and so on in synchronism with the formation of the toner image. A transfer roller 4 is disposed as transfer means at the transfer position, and the toner image on the photosensitive drum 1 is transferred onto the recording medium P by application of a voltage.

The recording medium P to which the toner image has been transferred is conveyed to fixing means 5 by a conveying guide 23. The fixing means 5 includes a driving roller 5*c* and a fixing roller 5*a* having a heater 5*b* therein which applies a heat and a pressure to the recording medium P which is passing through the fixing means 5 to fix the transferred toner image onto the recording medium P. Thereafter, the recording medium P is externally discharged from the apparatus.

The photosensitive drum 1 after the toner image thereon has been transferred onto the recording medium P by the transfer roller 4, is subjected to a succeeding image forming process after the developer remaining on the photosensitive drum 1 has been removed by cleaning means 6. The cleaning means 6 scrapes off the residual developer on the photosensitive drum 1 by an elastic cleaning blade 7 disposed so as to be abutted against the photosensitive drum 1 and collects the residual developer into a waste developer reservoir 8.

As described above, in the developing device 10, because the developer T is consumed every time the developing operation is repeated, it is necessary to monitor the presence and absence of the developer T in the developing portion 13 at any time so as to prevent the shortage of the developer T.

Under the above circumstances, the conventional developing device 10 includes a developer amount detecting device as means for detecting the residual amount of the developer, and the developer amount detecting device includes an antenna electrode 18 for detection of the residual amount of the developer, which is disposed horizontally in the interior of the developing portion 13 in order to detect the residual amount of the developer T.

The developer amount detecting device further includes a developer amount measuring circuit 50 which is equipped with a capacitance detecting circuit 52 as means for measuring a capacitance between the antenna electrode 18 and the developing roller 12. The capacitance detecting circuit 52 is connected with the antenna electrode 18. With this structure, the developing bias voltage which is applied to the developing roller 12 by the developing bias power supply 54 is detected by the antenna electrode 18 to measure the capacitance between the antenna electrode 18 and the developing roller 12.

The developer amount measuring circuit 50 also includes a reference capacitance 53 as means for setting a capacitance that is a reference for comparison and a capacitance detecting circuit 51 as means for measuring the reference capacitance 53. The reference capacitance 53 and the developing bias power supply 54 are connected to each other, and the developing bias voltage is detected through the reference capacitance 53, to thereby obtain the capacitance that is a reference in measurement of an unknown capacitance.

The developer amount detecting device compares an output of the capacitance detecting circuit 52 with an output of the capacitance detecting circuit 51 for the reference capacitance by a comparing circuit 55 serving as comparing means to detect a difference therebetween, and judges the depletion of developer T by a developer amount warning circuit 57 to notify a user that the developer T is little, if the difference is lower than a given value.

As described above, in the conventional image forming apparatus, the antenna electrode 18 for detection of the residual amount of developer T is disposed in the developing portion 13, and in the detecting method, a time immediately before the developer is emptied, can be accurately detected.

On the contrary, if the residual amount of developer T within the developer container can be sequentially detected, the user can be notified of a state in which the developer within the developer container is consumed. Therefore, the user can prepare a new process cartridge for a replacement timing.

In view of the above, in order to sequentially detect the residual amount of developer T, there has been proposed a method of counting a number of prints and a method in which a period of time of producing a light emission signal to a laser or the like which forms the electrostatic latent image is integrated so as to sequentially grasp the residual amount of developer T. However, in the conventional method, there is a fear that an error becomes large due to a variation of the consumed amount of toner caused by the fluctuation of environments where the apparatus is employed or a variation of the printing ratio of the print image.

SUMMARY OF THE INVENTION

The present invention has been made in view of the above circumstances, and therefore an object of the present invention is to provide a developing device, a process cartridge and an electrophotographic image forming apparatus capable of sequentially detecting the residual amount of developer.

Another object of the present invention is to provide a developing device, a process cartridge and an electrophotographic image forming apparatus, capable of sequentially detecting the residual amount of developer with high accuracy.

Still another object of the present invention is to provide a developing device, a process cartridge and an electrophotographic image forming apparatus, equipped with developer amount detecting means that can detect the residual amount of developer from a state in which the developer is full to a state immediately before printing becomes defective accurately, which are inexpensive and capable of improving convenience when the user employs the apparatus.

Yet another object of the present invention is, in an apparatus having a plurality of developing devices, to provide a developing device, a process cartridge and an electrophotographic image forming apparatus, equipped with inexpensive developer amount detecting means that can detect the residual amount of developer from a state in which the developer of each developing device is full to a state immediately before printing becomes defective independently and accurately, which are capable of improving convenience when the user employs the apparatus.

Another object of the present invention is to provide a developing device, a process cartridge having the developing device and an electrophotographic image forming apparatus to which the process cartridge is detachably mountable, the developing device comprising a developer residual amount detecting electrode pair having first and second electrodes disposed to interpose the developing portion and the hopper portion therebetween in order to detect the residual amount of developer by the main body of the electrophotographic image forming apparatus, in which the first electrode of the developer residual amount detecting electrode pair comprises the developer bearing member, and the second electrode thereof is fitted on an outer wall of the developer container.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Figure 1:
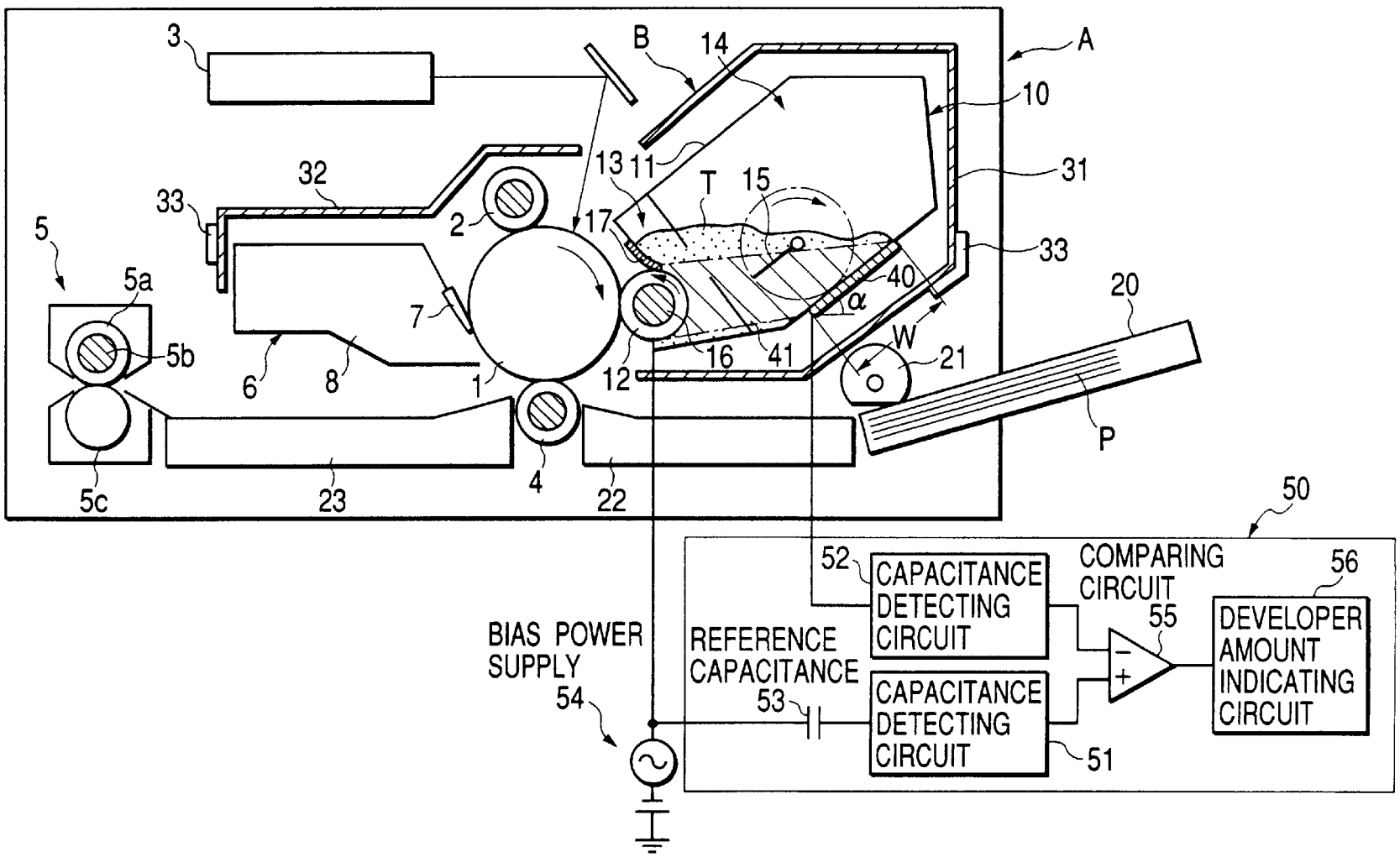
FIG. 1 is a structural diagram showing the outline of an image forming apparatus in accordance with an embodiment of the present invention.

Hereinafter, a description will be given in more detail of a developing device, a process cartridge and an electrophotographic image forming apparatus in accordance with the present invention with reference to the accompanying drawings.

FIRST EMBODIMENT

First, a description will be given of an electrophotographic image forming apparatus to which a process cartridge is detachably mountable in accordance with an embodiment of the present invention with reference to FIG. 1. In this embodiment, the electrophotographic image forming apparatus is directed to an electrophotographic laser beam printer by which an image is formed on a recording medium such as a recording sheet, an OHP sheet or a cloth through an electrophotographic image forming process.

A laser beam printer A includes a drum-shaped electrophotographic photosensitive member, that is, a photosensitive drum 1. The photosensitive drum 1 is charged by a charging roller 2 that is charging means that constitutes electrostatic latent image forming means. Then, a laser beam is irradiated onto the photosensitive drum 1 from optical means 3 having a laser diode, a polygon mirror, a lens, a reflecting mirror (not shown) in response to image information, to thereby form a latent image corresponding to the image information on the photosensitive drum 1. The latent image is developed by a developing device 10 that serves as the developing means of a process cartridge B to form a visible image, that is, a toner image.

The developing device 10 is equipped with a developer container 11 that includes a developing portion 13 with a developing roller 12 that serves as a developer bearing member, and a developer hopper portion 14. In the case where a developer T contained in the developing portion 13 and the hopper portion 14 is consumed, a user per se replaces the cartridge B by a new one so that the developing device 10 can conduct a new printing operation.

Also, the developing device 10 is equipped with an agitating device 15 within the developer hopper portion 14 for the purposes of preventing the developer T from being stuck onto the interior and of circulating and feeding the developer T. The agitating device 15 can be made of a resin film such as PET (polyethylene terephthalate), a rubber material such as silicone rubber or urethane rubber, or a sheet metal such as SUS or phosphor bronze. The agitating device 15 is rotated by driving means (not shown) in a direction indicated by an arrow.

Also, in this embodiment, the developing roller 12 has stationary magnet 16 therein, and the developer T is fed by the rotation of the developing roller 12. Triboelectrification charges are given to the developer T and also formed into a developer layer having a given thickness by the developing blade 17 that serves as the developer amount regulating member, and are supplied to the developing region of the photosensitive drum 1. The developer supplied to the developing region is transferred to a latent image on the photosensitive drum 1 to form a toner image. The developing roller 12 is connected to a developing bias power supply 54, and a developing bias voltage resulting from superimposing a d.c. voltage on an a.c. voltage is normally applied to the developing roller 12.

Also, in this embodiment, the developing device 10 uses a magnetic developer containing a magnetic substance as the developer T, however, nonmagnetic developer containing no magnetic substance may be used as the developer T. Therefore, the developing device 10 may be structured as a magnetic monocomponent developing device in which the developer per se contains magnetic carriers therein as in this embodiment. Also, the developing device 10 may be formed of a two-component developing device having the magnetic carriers or a nonmagnetic monocomponent developing device using no magnetic carriers.

The developer T which is contained and used in the developing device 10 is produced through a crushing method or a polymerizing method, and in the developing device 10 of this embodiment, a developer small in average particle diameter is employed so as to reproduce even a fine image.

On the other hand, a recording medium P set in a sheet feeding cassette 20 is conveyed to a transfer position by a pickup roller 21 and conveying means 22 having a conveying roller pair, a registration roller (not shown) and so on in synchronism with the formation of the toner image. A transfer roller 4 is disposed as transfer means at the transfer position, and the toner image on the photosensitive drum 1 is transferred onto the recording medium P by application of a voltage.

The recording medium P to which the toner image has been transferred is conveyed to fixing means 5 by a conveying guide 23. The fixing means 5 includes a driving roller 5*c* and a fixing roller 5*a* having a heater 5*b* therein which applies a heat and a pressure to the recording medium P which is passing through the fixing means 5 to fix the transferred toner image onto the recording medium P. Thereafter, the recording medium P is discharged to the external of the apparatus.

The photosensitive drum 1 after the toner image has been transferred onto the recording medium P by the transfer roller 4, is subjected to a succeeding image forming process after the developer remaining on the photosensitive drum 1 has been removed by cleaning means 6. The cleaning means 6 scrapes off the residual developer on the photosensitive drum 1 by an elastic cleaning blade 7 disposed so as to be abutted against the photosensitive drum 1 and collects the residual developer into a waste developer reservoir 8.

On the other hand, in this embodiment, a process cartridge B makes a developing frame 31 that holds the developer container 11 that constitutes the developing device 10, etc., and a cleaning frame 32 to which the cleaning means 6 such as the cleaning blade 7 and the charging roller 2 are fitted integrally into a cartridge.

The process cartridge B is detachably mounted onto cartridge mounting means 33 disposed in a main body of an electrophotographic image forming apparatus.

In this embodiment, the process cartridge B is equipped with a developer amount detecting device which is capable of sequentially detecting the residual amount of developer as the developer in the developing portion 13 and the hopper portion 14 is consumed.

According to this embodiment, the developer amount detecting device includes a developer residual amount detecting electrode pair having first and second electrodes 12 and 40, a capacitance detecting circuit 50 serving as developer amount detecting means, and an alternate bias power supply 54 serving as bias voltage applying means. That is, in this embodiment, the first electrode of the electrode pair is the developing roller 12, and the other second electrode is a metal sheet member disposed opposite to the developing roller 12, that is, a metal plate 40. The metal plate 40 may be formed of, for example, an arbitrary metal plate having about 0.1 to 1 mm in thickness, such as aluminum sheet or stainless steel sheet. In this example, the second electrode 40 is disposed along the longitudinal direction of the developing roller 12.

Figure 2:
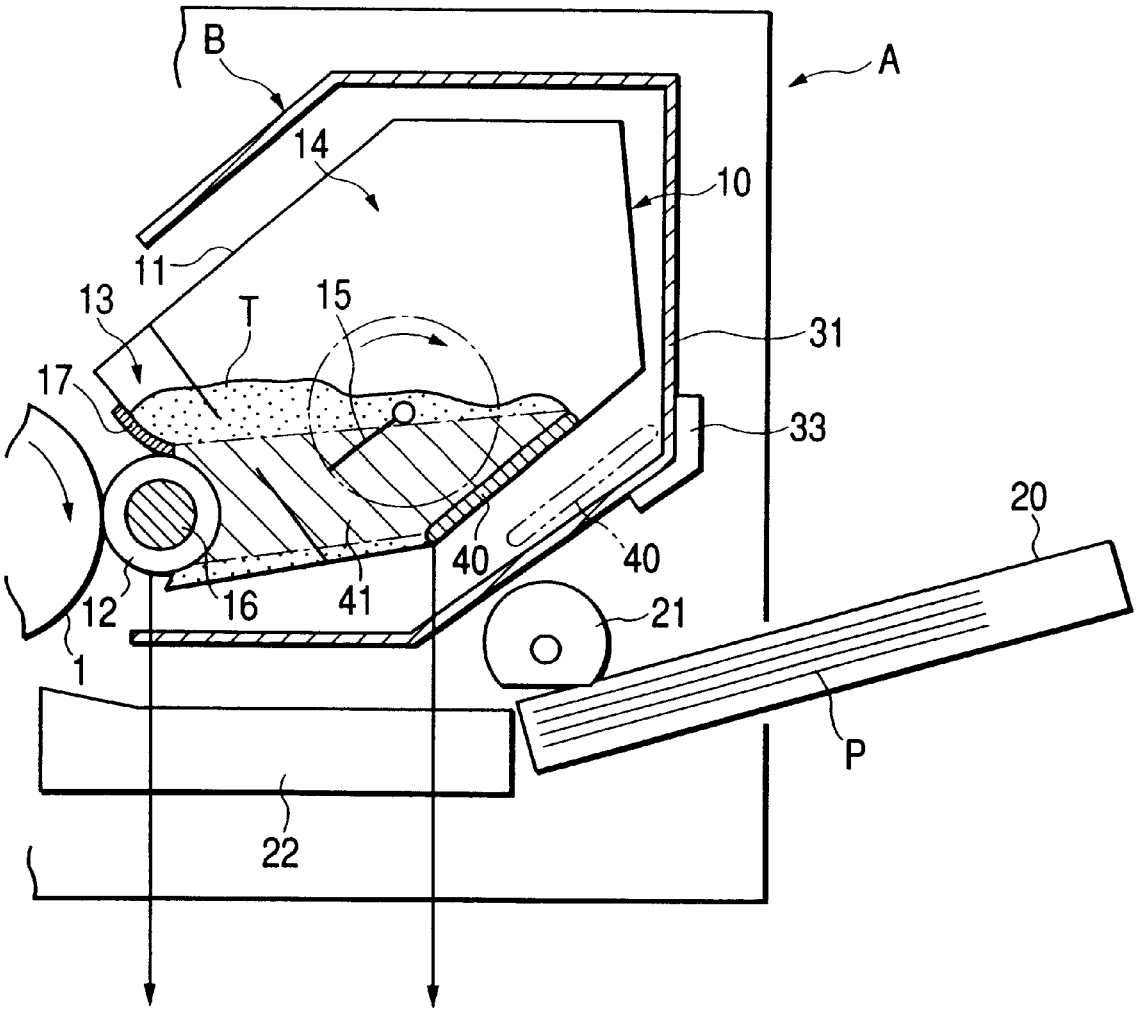
FIG. 2 is a structural diagram partially showing the outline of an image forming apparatus in accordance with another embodiment of the present invention.

The second electrode 40 is fitted to the outer side of the developer container 11. However, the present invention is not limited to this, but, the second electrode 40 may be disposed, for example, within the developer container 11 as shown in FIG. 2. As occasion demands, the second electrode 40 may be fitted to not the developing device but the developing frame 31 as indicated by a dashed line in FIG. 2 or the main body of the image forming apparatus. In this event, since the electrode does not need to be fitted to the developing device 10, the developing device can be simplified and the costs of the developing device can be reduced.

Also, in this embodiment, the metal plate 40 as the second electrode is so disposed as to extend as long as the length of the developing roller 12 in the longitudinal direction. Further, in this embodiment, the metal plate 40 is set to about 20 mm in width (W) and so disposed as to be inclined at an angle of $\alpha$=about 37° with respect to a plane that connects the outer periphery of the developing roller 12 and a lower end of the metal plate. In this embodiment, the diameter of the developing roller 12 is set to 16 mm.

According to this embodiment, the electrode pairs 12 and 40 are so disposed as to be opposed to each other on a line penetrating the developing portion 13 and the hopper portion 14 of the developing device 10, independently or together. Further, the electrode pairs 12 and 40 are disposed in such a manner that a space region 41 (a region indicated by an oblique line in FIGS. 1 and 2) defined by the electrode pairs 12 and 40 opposed to each other includes substantially 20% or more of the developer T which is filled in the developing portion 13 and the hopper portion 14 in a full state.

The configuration of the electrode pair in this embodiment may be modified if the above relationship is satisfied, and is not limited to the above-described developing roller 12 and metal plate 40. For example, there may be a case in which a base of the developing blade 17 that regulates the developer on the developing roller 12 is formed of a metal blade made of phosphor bronze or the like, and the same developing bias as that of the developing roller 12 is applied to the developing blade 17. In this case, since the amount of developer contained between the first electrode 12 and the second electrode 40 increases, the precision can be improved.

Also, one electrode of the electrode pair is applied with an alternate bias voltage such as a sine wave, a rectangular wave, a chopping wave or a repetitively pulsed wave in order to measure the capacitance between those electrodes. However, in this embodiment, because the developing roller 12 serves as the first electrode, the developing bias voltage is employed with any changes as the alternate bias voltage to be applied to the developing roller 12.

Accordingly, the second electrode that is formed of the metal plate 40 and disposed on a back surface of the hopper portion constitutes a receive-side electrode, and its output terminal is connected to the capacitance detecting circuit 50.

Subsequently, the capacitance detecting circuit 50 will be described with reference to FIGS. 1 and 3.

The capacitance detecting circuit 50 is made up of a first capacitance detecting circuit 51 and a second capacitance detecting circuit 52 connected to the second electrode 40 formed of the metal plate. The first capacitance detecting circuit 51 is connected to an alternate bias power supply 54 through a reference capacitance 53, and the same bias voltage as the alternate bias voltage applied to the developing roller 12 which serves as the transmittal-side first electrode is branched from the alternate bias power supply 54 and applied to the first capacitance detecting circuit 51.

The capacitance detecting circuit 50 also includes a comparing circuit 55 and compares a signal measured through the reference capacitance 53 with a signal measured through the second antenna electrode 40 by the comparing circuit 55 to detect if the capacitance is larger or smaller as compared with a state in which the capacitance between the developing roller 12 and the antenna electrode 40 is full, or a state in which no developer exists. A detected signal is transmitted to a developer amount indicating circuit 56 where the residual amount of developer is sequentially indicated.

Figure 4:
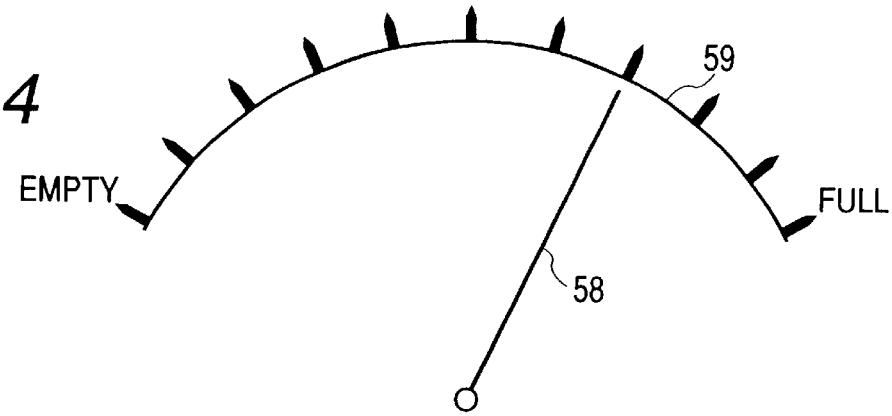
FIG. 4 is a diagram showing a developer amount indication in accordance with an embodiment of the present invention.
Figure 5:
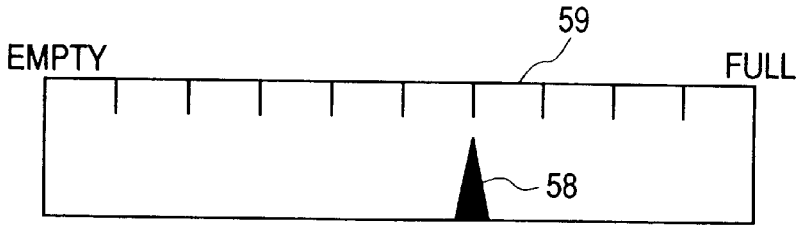
FIG. 5 is a diagram showing a developer amount indication in accordance with another embodiment of the present invention.

A developer indicating method will be described. For example, the detected information by the above-described developer amount detecting device is indicated on a screen of a terminal such as a user's personal computer as shown in FIGS. 4 and 5. In FIGS. 4 and 5, a pointer 58 which moves in response to the amount of developer indicates any position of a gage 59 so as to notify the user of the amount of developer.

Figure 6:
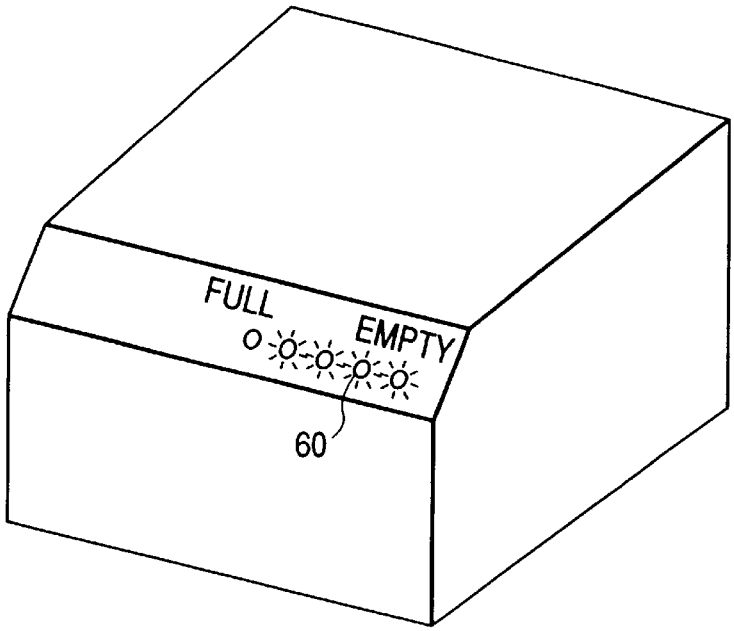
FIG. 6 is a diagram showing a developer amount indication in accordance with still another embodiment of the present invention.

Also, as shown in FIG. 6, an indicating portion such as an LED 60 may be disposed directly on the main body of the electrophotographic image forming apparatus to flash the LED in response to the amount of developer.

The present inventor sets the capacitance in a state where the process cartridge is emptied, that is, in a state where no developer T exists in the developing portion 13 and the hopper portion 14 of the developing device 10, to the reference capacitance 53. However, because the capacitance between the electrodes 12 and 40 of the empty cartridge is extremely small to the degree of about 1 pF, in fact, it is impossible to realize the reference capacitance by a single capacitor.

Figure 3:
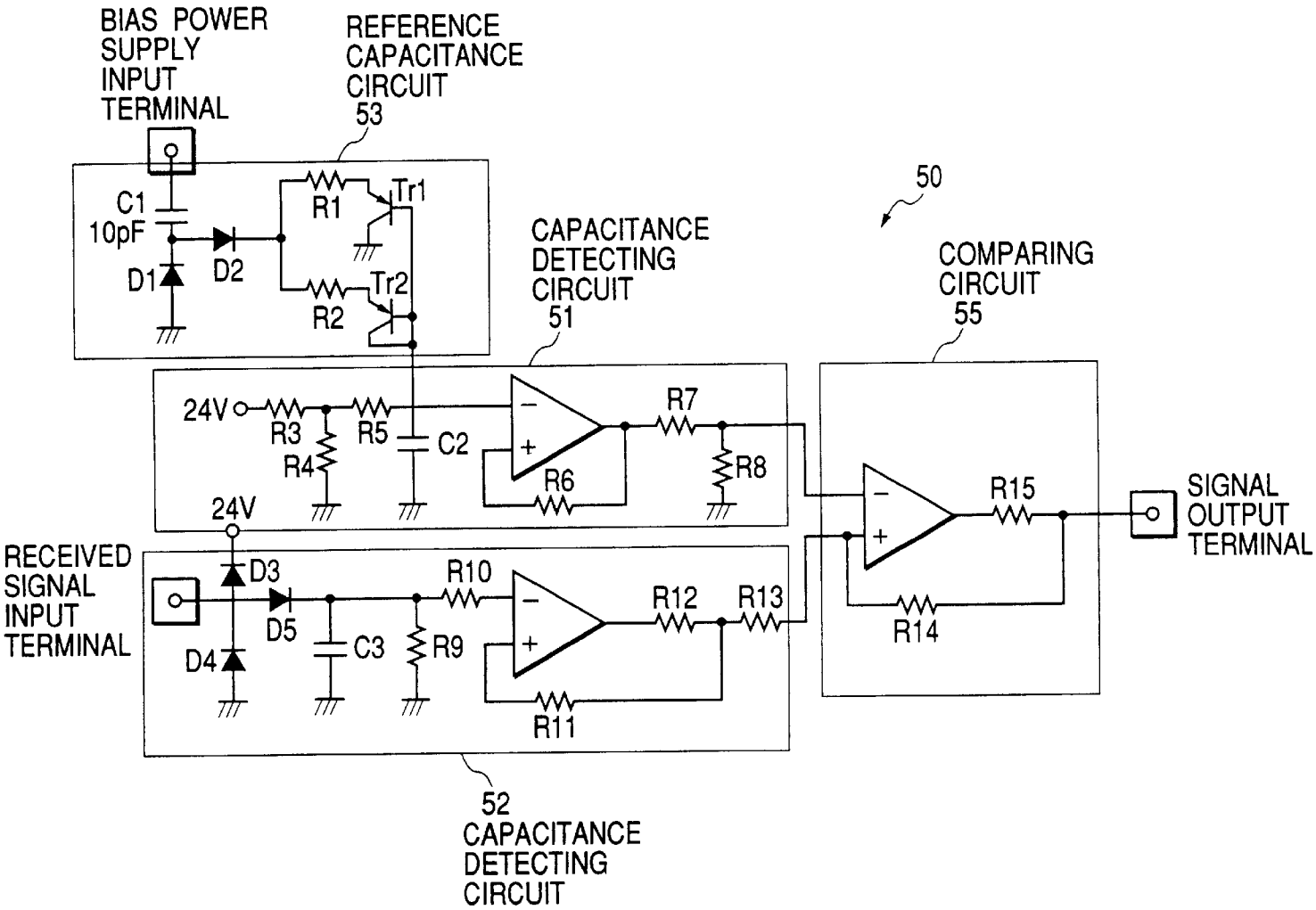
FIG. 3 is a developer amount measuring circuit for a developer residual amount detecting device in accordance with an embodiment of the present invention.

Under the above circumstances, in fact, as represented by the reference capacitance circuit 53 of the developer amount measuring circuit 50 shown in FIG. 3, the bias power supply 54 is connected with a capacitor C1 of 10 pF and a charging current to the capacitor C1 is divided by resistors R1 and R2 and detected from the antenna electrode 40. Then, the charging currents charged in the capacitors C2 and C3 are attenuated so as to have the same level, to thereby realize the apparent reference capacitance 53 of 1 pF.

Figure 7:
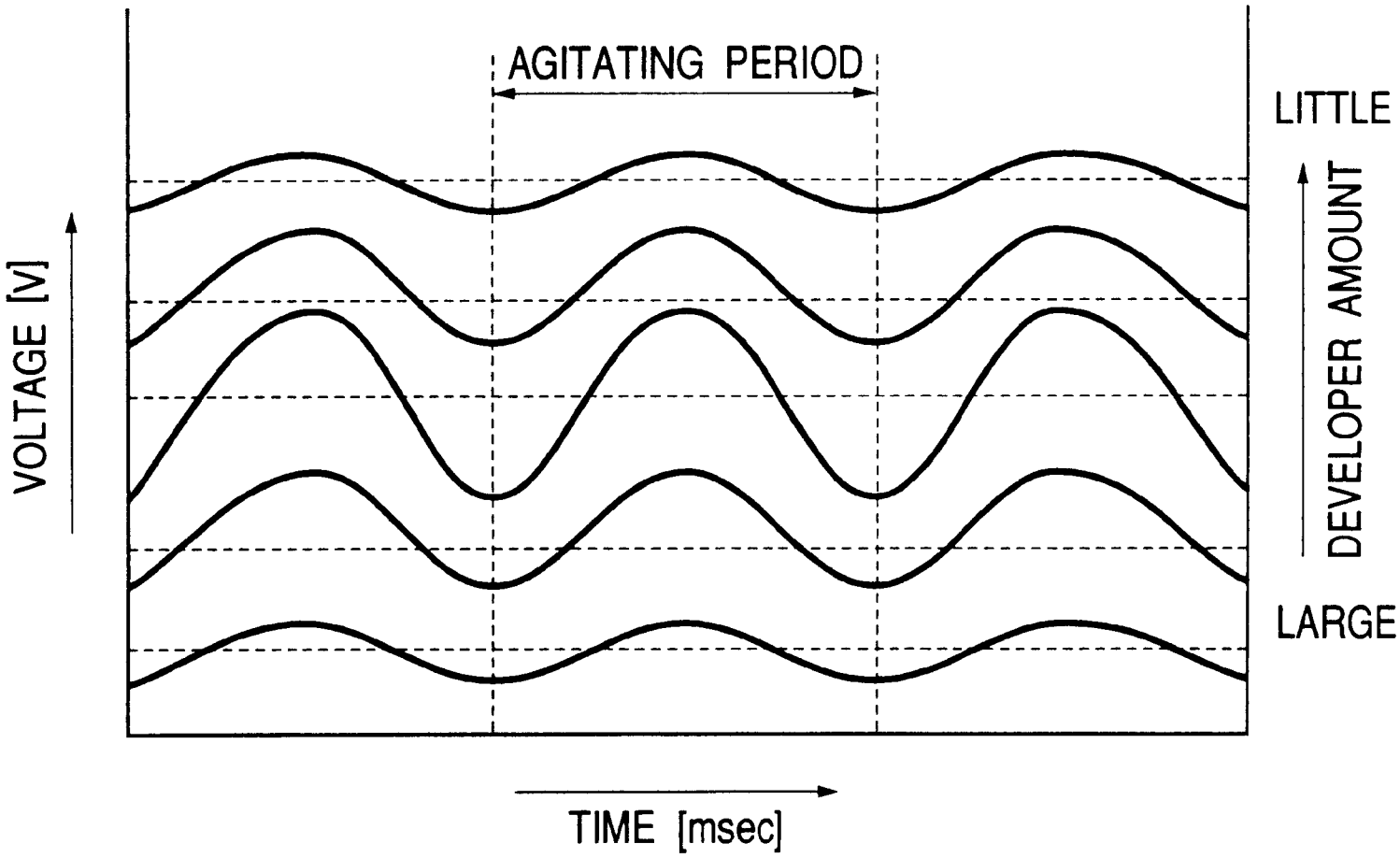
FIG. 7 is a graph for explaining the operation of the developer residual amount detecting device in accordance with the present invention.

FIG. 7 shows an output voltage from a capacitance detecting circuit 50 when the capacitance detecting circuit 50 shown in FIG. 3 is used for the developer amount detecting device of this embodiment. Because the developer T agitated by the agitating device 15 circulates within the hopper portion 14, the output of the capacitance detecting circuit 50 changes in accordance with an agitating period.

Figure 8:
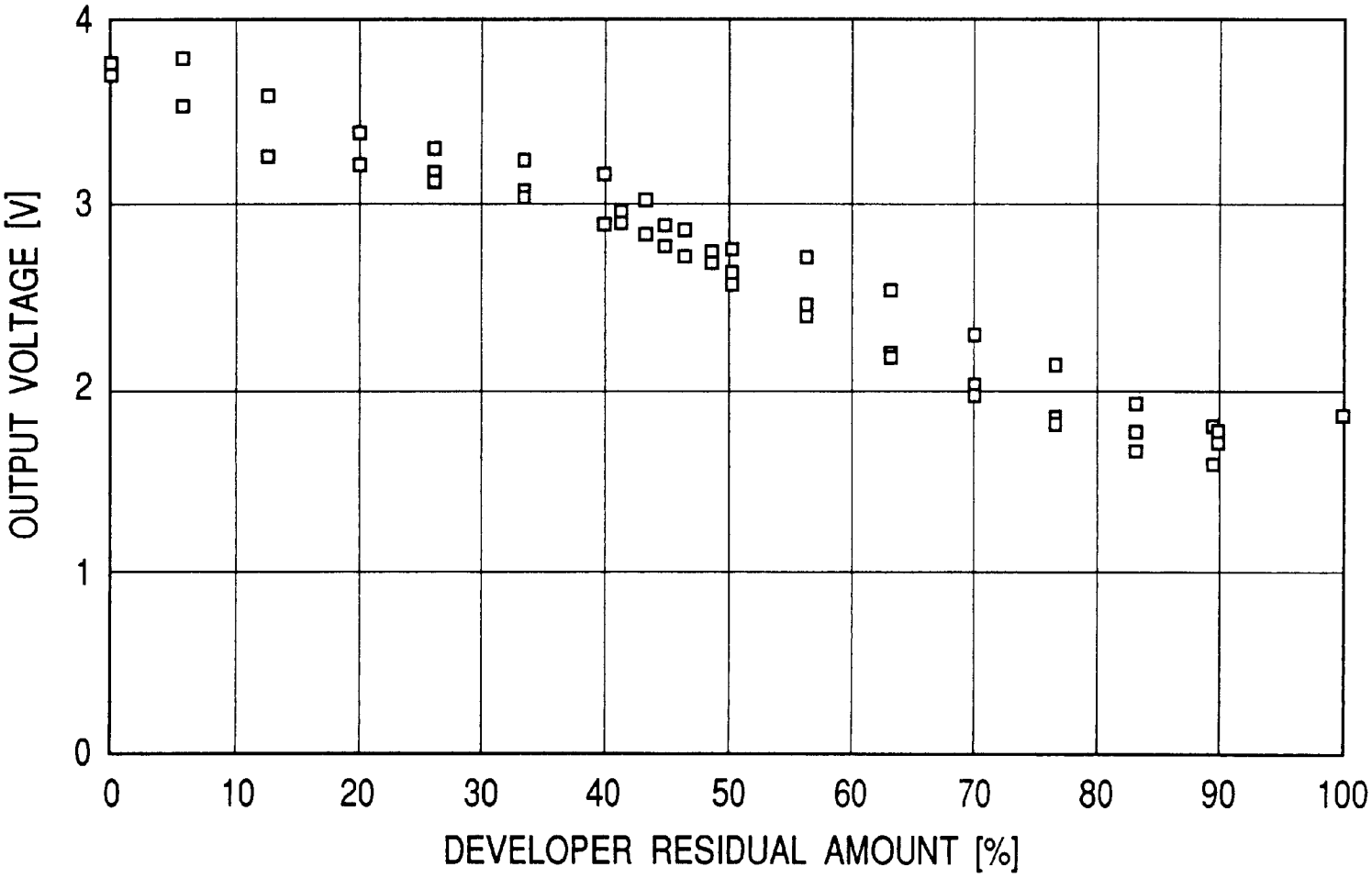
FIG. 8 is a graph for explaining the operation of the developer residual amount detecting device in accordance with the present invention.

Accordingly, the present inventor integrated the above output signal with the agitating period and compared the integrated average value with the amount of developer within the process cartridge. The results are shown in FIG. 8. As is understood from FIG. 8, it is found that the amount of developer from a state where the developer is full to a state where the developer is empty can be excellently detected.

Also, the present inventor proved the following fact as a result of reviewing a large number of electrode shapes. That is, unless, as described above, the electrode pair 12 and 40 of the developer residual amount detecting means put on a line that penetrates the developer portion 13 and the hopper portion 14 of the developing device 10 independently or together, and the electrode pair 12 and 40 are disposed such that the space region 41 defined by the electrode pair 12 and 40 includes substantially 20% or more of the developer T filled in the developing portion 13 and the hopper portion 14, the amount of developer which is substantially half or less of the full developer T by which the user's satisfaction can be ensured to a minimum cannot be detected accurately.

The above reason will be described with reference to FIGS. 9 and 10.

Figure 9:
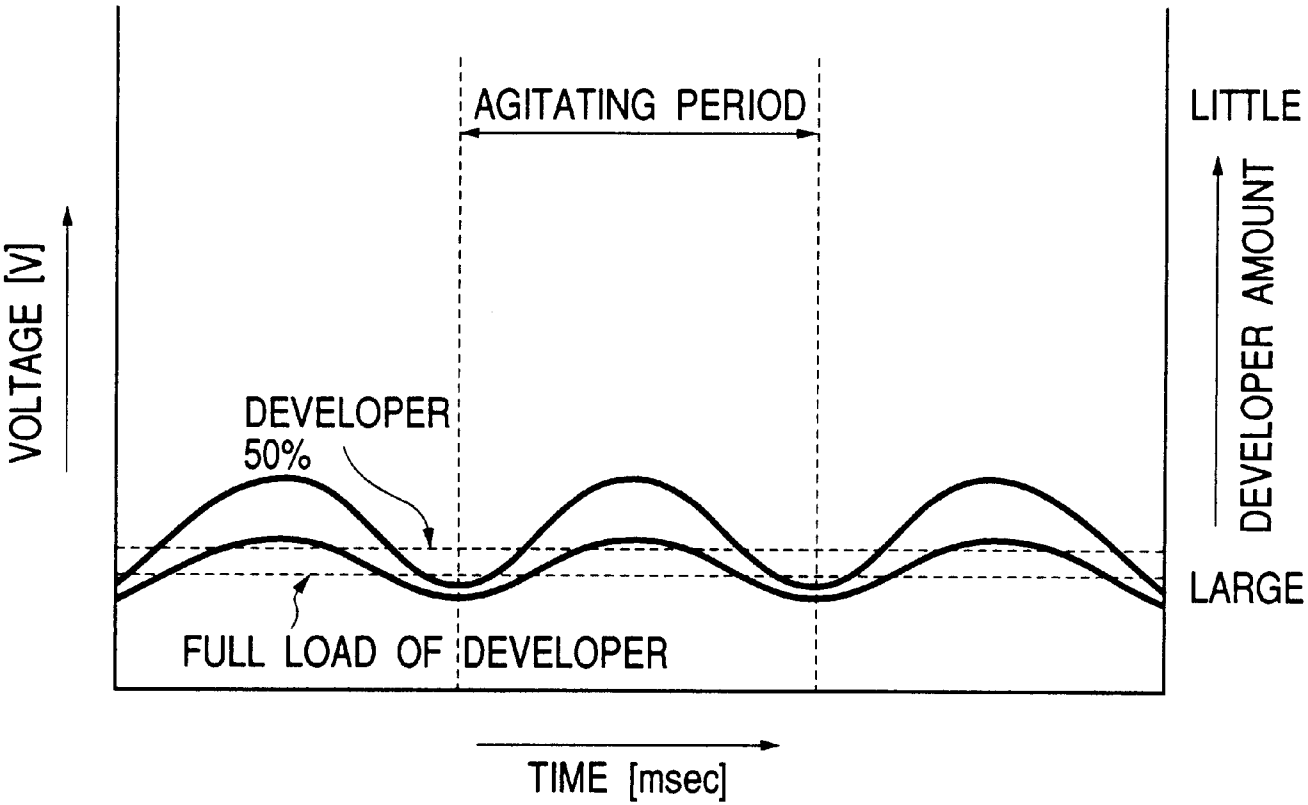
FIG. 9 is a graph for explaining the operation of the developer residual amount detecting device in accordance with the present invention.
Figure 10:
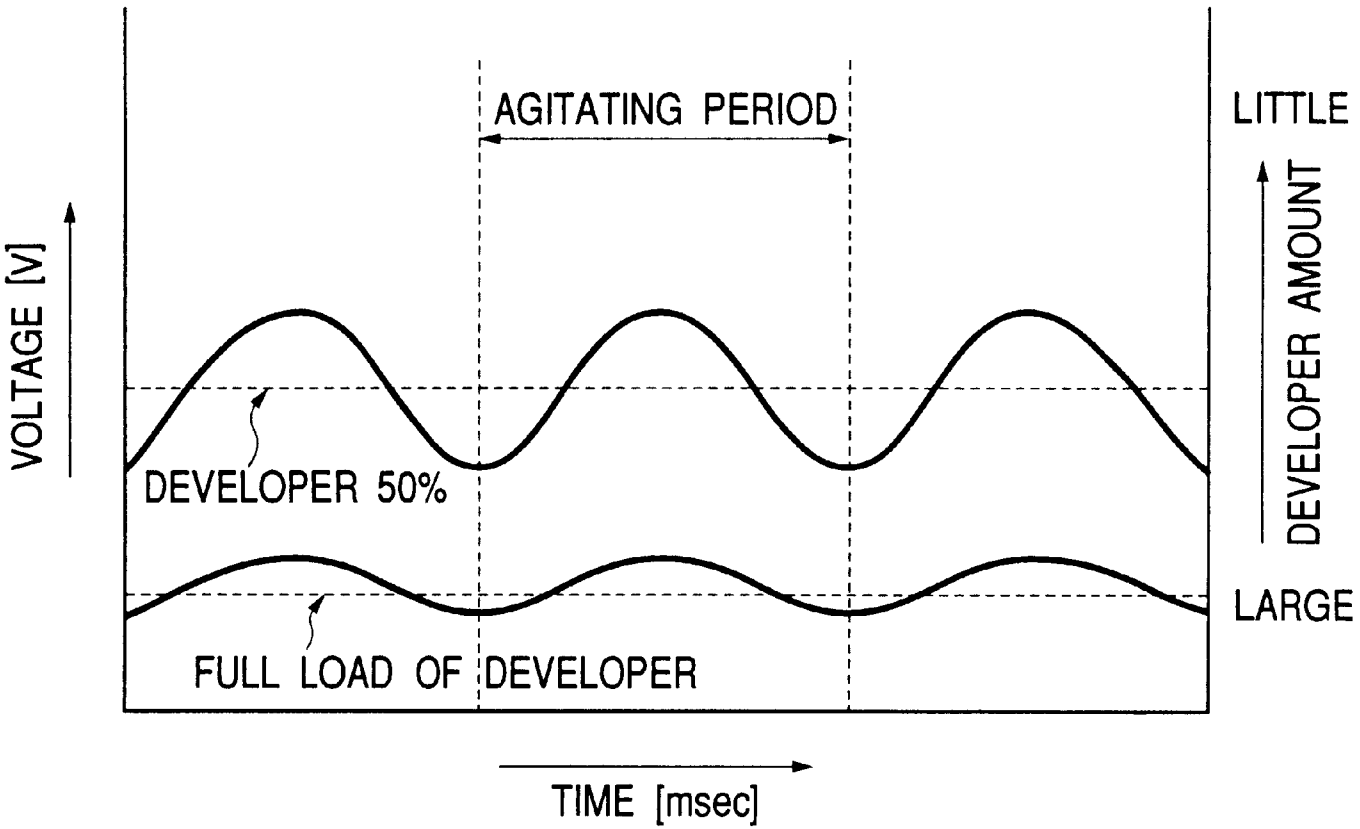
FIG. 10 is a graph for explaining the operation of the developer residual amount detecting device in accordance with the present invention.

FIGS. 9 and 10 show a detected signal obtained when the space region 41 defined between the above-described electrodes 12 and 40 is changed with respect to the process cartridge B which is fully filled with the developer T and filled with substantially half of the full developer T (50%). As can be understood from those figures, when the space region 41 defined between the electrodes 12 and 40 becomes small, a difference of signals between the full state and the half state is small, to thereby make discrimination difficult.

This is caused by the fact that because the developer T moves inside and outside of the space region 41 by the agitating device 15, the signal obtained by the structure of the present invention reflects the amount of developer outside of the space region 41 defined between the electrodes 12 and 40 to some degree of the amount.

In other words, because the amount of the developer T within the space region 41 which has been moved from the interior of the space region 41 defined between those electrodes to the exterior thereof by the agitating device 15 is rapidly supplemented by the developer T which has been outside of the space region 41 before movement due to the gravity, if a certain relationship is satisfied between the amount of developer to be measured and the space region 41 defined between the electrodes, the residual amount of developer T outside of the space region 41 is also reflected by the signal.

Accordingly, if the space region 41 and the amount of developer to be measured becomes lower than a given relationship, because a period of time where the space region 41 is always fully filled with the developer in a region other than the space region 41 becomes much, even if the average value resulting from integrating the detected signal with the agitating period is used, a signal which cannot be distinct from the signal in the full state as an output waveform is produced.

The above relationship depends on the position, the size, etc., of the second electrode 40 as well as the shape of the hopper portion 14 and the shape of the agitating device 15. As a result that the present inventor employed the shape of the hopper portion and the shape of the agitating device which are the highest in the precision of detection, it was found that unless at least substantially 20% or more of the developer T filled in the developing portion 13 and the hopper portion 14 is covered by the space region 41, it is impossible to discriminate the state where the developer T is full and the state where the developer T is substantially half of the full.

It is needless to say that as the space region 41 defined between the electrodes 12 and 40 covers the space filled with the developer T more, even the amount of developer which is more than the half can be detected, and it is necessary to obtain the cover ratio of substantially 40 to 60% or more in linearly measuring the amount of developer from the state where the developer is full to the state where the developer is empty.

Now, the space in the developing portion 13 and the hopper portion 14 which is filled with the developer T will be described.

The space filled with the developer T which is described according to the present invention is directed to a stationary volume of the developer T filled in the developing portion 13 and the hopper portion 14. The stationary volume is directed to the volume of developer in a state where the developer T becomes still due to the self-weight of the developer T when the developing device 10, that is, the process cartridge B becomes stationary in the same state as that of detecting the developer residual amount, and the stationary volume is neither the volume of developer when the developer is movable nor the volume of the developing portion 13 and the hopper portion 14.

Also, in this embodiment, the developing roller 12 is used as one electrode of the developer residual amount detecting electrode pair, and the developing bias voltage is used as the alternate bias voltage. However, it can be understood that the present invention is achieved if the relationship between the electrodes satisfies the above-described relationship, and there is no necessity that the alternate bias voltage is used for the developing bias voltage.

For example, in case of the developing device 10 using only a d.c. bias voltage as the developing bias voltage, it is unnecessary that one of the electrode pair is formed of the developing roller 12, and the developing bias power supply cannot be diverted to the alternate bias power supply 54. In this case, the electrode pair and the alternate bias power supply may be provided separately.

SECOND EMBODIMENT

Figure 11:
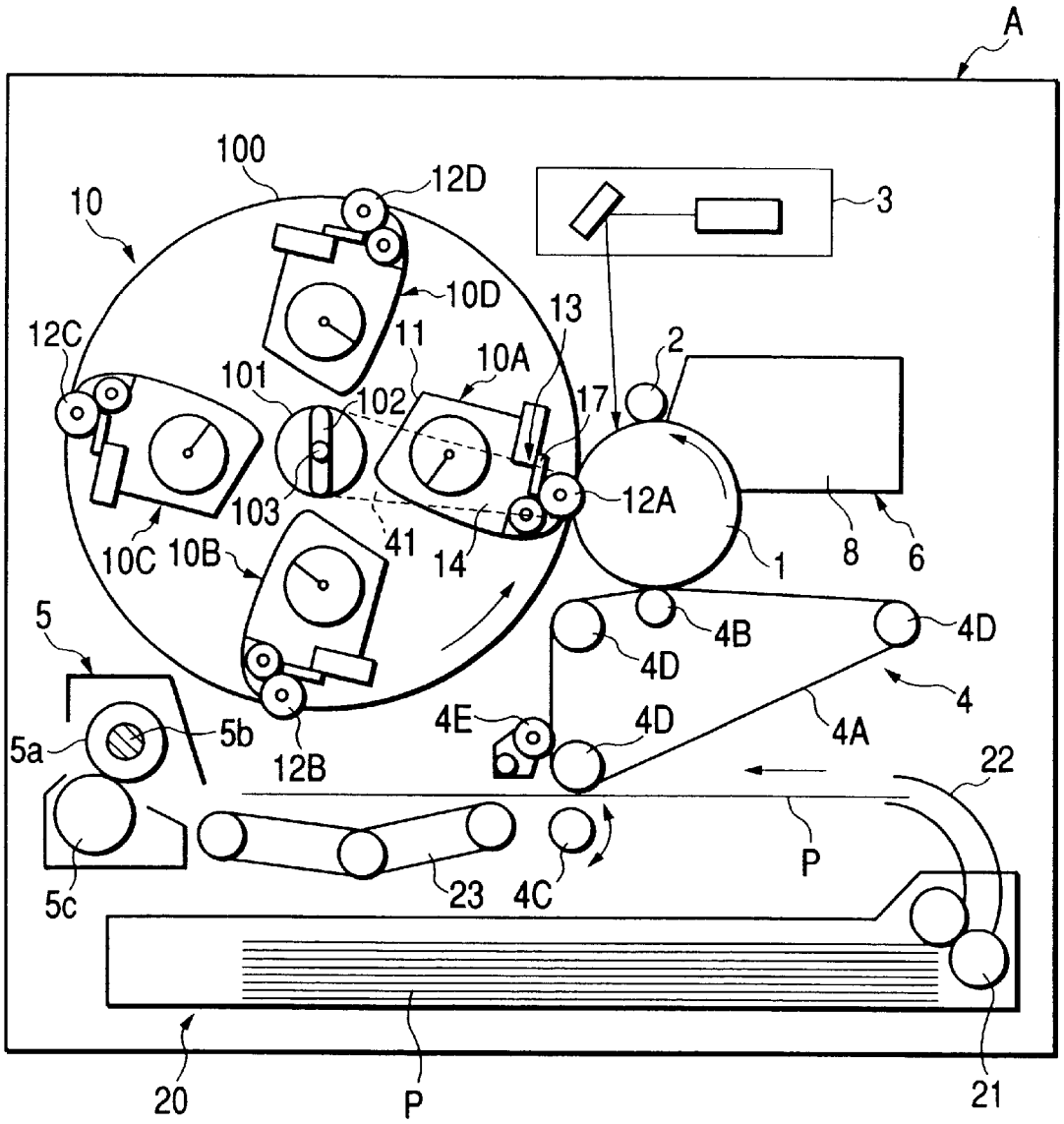
FIG. 11 is a structural diagram showing the outline of an image forming apparatus in accordance with another embodiment of the present invention.

Subsequently, an image forming apparatus in accordance with a second embodiment of the present invention will be described with reference to FIG. 11. The image forming apparatus according to this embodiment is largely different from the image forming apparatus according to the first embodiment in that a plurality of developing devices 10A, 10B, 10C and 10D each made into a cartridge are mounted on a support member 100, the support member 100 is borne on a rotating shaft 101 situated in the center thereof, and the rotation of the respective developing devices 10A, 10B, 10C and 10D is controlled.

The structure of the respective developing devices 10A, 10B, 10C and 10D are identical with that of the developing device 10 described in the first embodiment. That is, the developing device 10 which stops at a developing position opposite to the photosensitive drum 1 will be representatively described with reference to FIG. 11. The developing device 10A includes a developer container 11, and the developer container 11 includes a developing portion 3 with a developing roller 12A that serves as a developer bearing member, and a developer hopper portion 14. In the case where a developer T contained in the developing portion 13 and the hopper portion 14 is consumed, the developing device 10A is replaced by a new developing device.

In this embodiment, the developing devices 10A, 10B, 10C and 10D can be so structured as to provide the respective color developers T of yellow, magenta and cyan as chromatic colors and a black developer T for under color removal (UCR), respectively. Also, the respective developing devices 10A, 10B, 10C and 10D are so structured as to be detachably mounted on the support member 100 for each color.

In formation of an image, the respective developing devices 10A, 10B, 10C and 10D are rotated about the rotating shaft 101 in a state where those developing devices 10A, 10B, 10C and 10D are held on the support member 100, and a given developing device stops at a position opposite to the photosensitive drum 1 and develops an electrostatic latent image formed on the photosensitive drum 1 to produce a toner image. The toner image is transferred on an intermediate transfer member 4 at a transfer position.

In this embodiment, the intermediate transfer member 4 includes an intermediate transfer belt 4A which is wound on a roller 4D and rotates. Also, transfer rollers 4B and 4C are disposed at the transfer position.

In formation of a color image, the rotating support member 100 rotates every one revolution of the intermediate transfer member 4, that is, the intermediate transfer belt 4A, and a developing process is conducted in the stated order of the yellow, magenta, cyan and black developing devices 10A, 10B, 10C and 10D. Then, a toner image on the photosensitive drum 1 is multi-transferred on the intermediate transfer belt 4A four times by application of a voltage at a first transfer position under the action of the transfer roller 4B that serves as the transfer means.

On the other hand, a recording medium P set in a sheet feeding cassette 20 is conveyed to a transfer position by a pickup roller 21 and conveying means 22 having a conveying roller pair, a registration roller (not shown) and so on in synchronism with the formation of the toner image. A transfer roller 4C is disposed as the transfer means at a second transfer position, and the toner images of the respective colors on the intermediate transfer belt 4A on which the toner images have been multi-transferred are transferred onto the recording medium P collectively and simultaneously by application of a voltage.

The recording medium P to which the toner images have been transferred is conveyed to fixing means 5 by a conveying guide 23. The fixing means 5 includes a driving roller 5*c* and a fixing roller 5*a* having a heater 5*b* therein which applies a heat and a pressure to the recording medium P which is passing through the fixing means 5 to fix the transferred toner images onto the recording medium P. Thereafter, the recording medium P is externally discharged from the apparatus.

The photosensitive drum 1 the toner images on which have been transferred onto the intermediate transfer belt 4A is subjected to a succeeding image forming process after the developer remaining on the photosensitive drum 1 has been removed by cleaning means 6. The cleaning means 6 scrapes off the residual developer on the photosensitive drum 1 by an elastic cleaning blade disposed so as to be abutted against the photosensitive drum 1 and collects the residual developer into a waste developer reservoir 8. Also, the residual developer on the intermediate transfer belt 4A is removed by cleaning means 4E.

According to this embodiment, at least one electrode of the developer residual amount detecting electrode pair as described in the first embodiment is disposed at a fixed position, and the developer residual amounts of the respective developing devices 10A, 10B, 10C and 10D which have been replaced by the movement of the support member 100 are measured at one position where the respective developing devices 10A, 10B, 10C and 10D are movable, to thereby measure the respective developer residual amounts of the plurality of developing devices 10A, 10B, 10C and 10D, independently.

Figure 12:
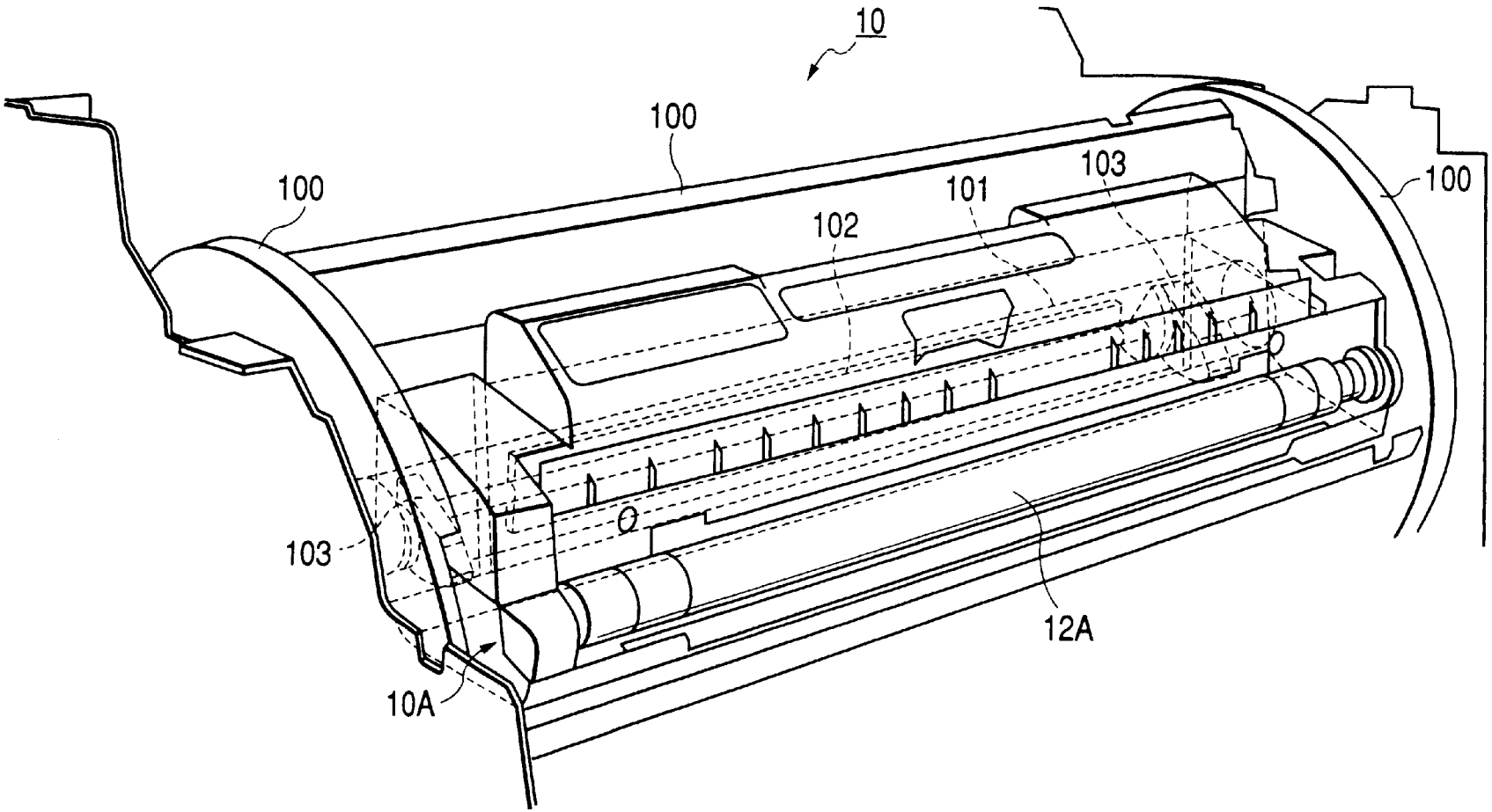
FIG. 12 is a perspective view showing a rotary type developing device for explaining a developer residual amount detecting electrode pair in the image forming apparatus shown in FIG. 11.
Figure 13:
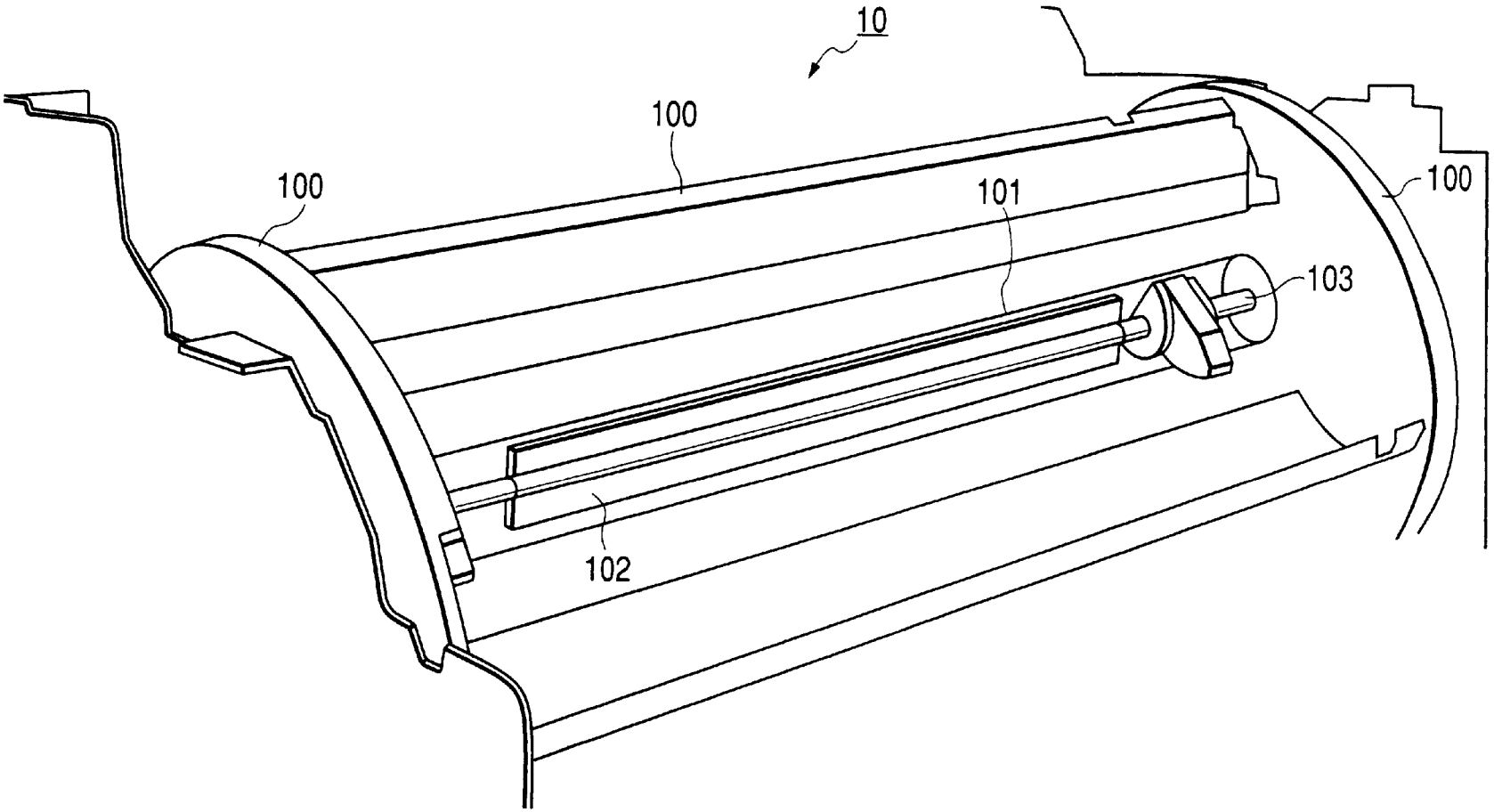
FIG. 13 is a perspective view showing the rotary type developing device in a state where the developing device is removed in FIG. 12.

In this embodiment, as is more understood with reference to FIGS. 12 and 13, the first electrodes of the developer residual amount detecting electrode pairs are formed of the developing rollers 12A, 12B, 12C and 12D of the respective developing devices 10A, 10B, 10C and 10D which are disposed at the developing positions as in the first embodiment, and the other second electrode is formed of an electrode 102 which is disposed in the interior of the hollow rotating shaft 101 which supports the support member 100 and rotates. The electrode 102 is disposed within the rotating shaft 101 and fitted on a fixed support member 103 which does not rotate.

When one of the developing rollers 12A, 12B, 12C and 12D of the respective developing devices 10A, 10B, 10C and 10D is moved to be placed opposite to the photosensitive drum 1, that is, when one of the respective developing devices 10A, 10B, 10C and 10D moves at the developing position, the second electrode 102 and the moved developing rollers 12A, 12B, 12C and 12D of the respective developing devices 10A, 10B, 10C and 10D are disposed at positions that satisfy the relationship between the first and second electrodes as described in the first embodiment. The electrode 102 is positioned and structured so as not to impede the movement of the developing devices, but disposed at a position as close as possible to the developing device which is moved to the developing position.

In other words, in this embodiment, the electrode pair 12 (12A, 12B, 12C and 12D) and 102 which are formed of the first and second electrodes are so disposed as to be opposed to each other on a line penetrating the developing portion 13 and the hopper portion 14 of the developing device 10, independently or together, as in the first embodiment. Further, the electrode pair 12 and 102 are disposed in such a manner that a space region 41 (a region indicated by an oblique line in FIG. 11) defined by the electrode pair 12 (12A, 12B, 12C and 12D) and 102 opposed to each other includes substantially 20% or more of the developer T which is filled in the developing portion 13 and the hopper portion 14 in a full state.

In the case where the second electrode 102 is fitted onto the fixed support member 103 as in this embodiment, since a wiring to the electrode 102 can be designed separately from the movable portion, a signal from the electrode 102 can be extracted directly, which is simple in structure and stable in output as compared with a case in which the signal is extracted through a sliding contact or the like from the interior of the support member 100. As a result, the developer residual amount can be accurately detected with high precision.

It is needless to say that if other electrically insulating property is satisfied, the fixed support member 103 per se may be structured as the second electrode.

Also, according to this embodiment, the detection electrodes included in the respective developing devices can be collected in one electrode 102 within the apparatus body, thereby enabling measurement more inexpensively.

Figure 14:
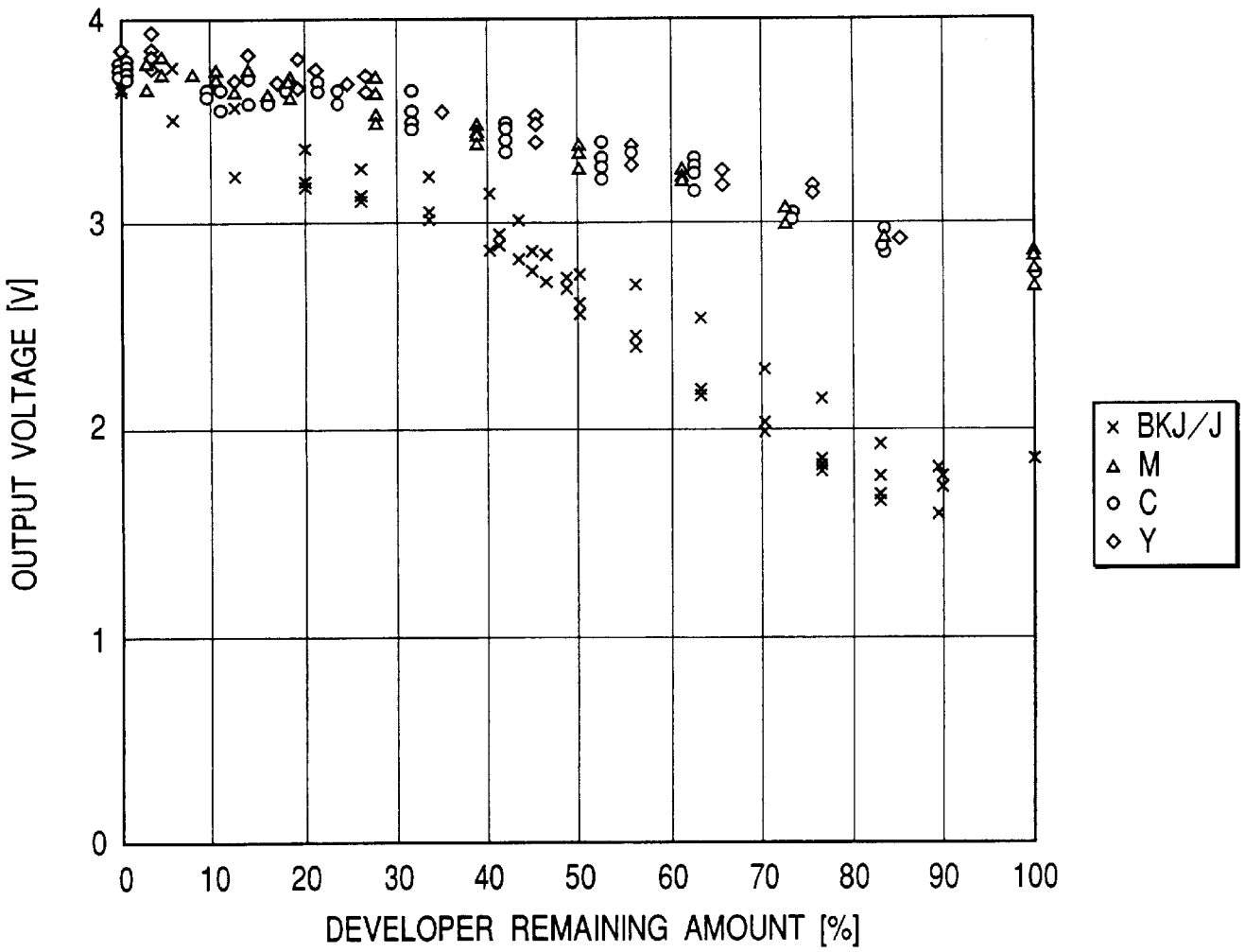
FIG. 14 is a graph for explaining the operation of the developer residual amount detecting device in accordance with the present invention.

Further, in this embodiment, the developer detecting circuit 50 as described in the first embodiment with reference to FIGS. 1 and 3 is applied. However, it was initially presumed that since the capacitance to be detected becomes smaller than that in the above first embodiment, it is impossible to realize the use of the developer detecting circuit 50. However, the present inventor conducted an experiment under the conditions where a model LBP-2040 manufactured by Canon was used as a specific example of the image forming apparatus shown in FIG. 11, and a metal electrode, specifically, a stainless steel electrode of 0.5 mm in thickness, 30 mm in width and 250 mm in length was located as the developer residual amount detecting electrode 102 on the fixed member that supports the rotating center of the rotating support member 100 in the image forming apparatus. As a result, the excellent results were obtained as shown in FIG. 14. The developer T used in this experiment is developers of Y (yellow), M (magenta) and C (cyan) including no magnetic substance therein and a black developer including the magnetic substance therein. The developer residual amount could be excellently measured by using same reference capacitance 53 in the developer detecting circuit 50 for both the developers different in characteristic.

Figure 15:
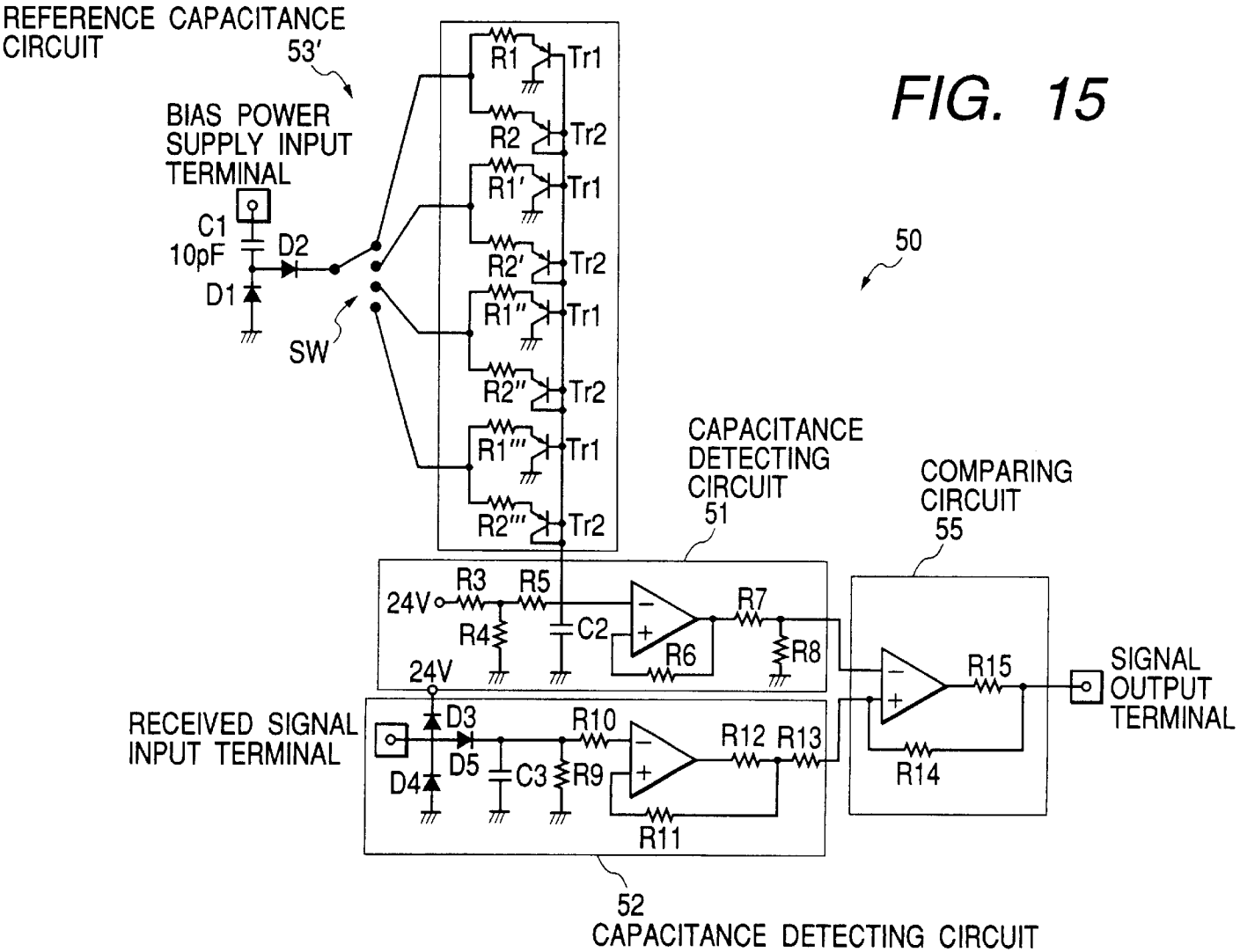
FIG. 15 is a developer amount measuring circuit for a developer residual amount detecting device in accordance with another embodiment of the present invention.

Because the above condition is not always applicable to all the image forming apparatuses, the developer detecting circuit 50 is equipped with a reference capacitance circuit 53' having a plurality of reference capacitances corresponding to the respective developing devices 10A, 10B, 10C and 10D, and a switch SW which can change over in correspondence with the respective developing devices as shown in FIG. 15.

In this embodiment, the developing rollers 12A, 12B, 12C and 12D are used as the first electrode of the developer residual amount detecting electrode pair, and the developing bias voltage is used as the alternate bias voltage. However, as described in the first embodiment, there is no necessity that the first electrode is formed of the developing roller, and the alternate bias voltage is not limited to the developing bias voltage. It is needless to say that the measuring position is not limited to the developing position, and the measurement may be made at a non-developing position. In particular, in case of the developing device where the respective developing devices 10A, 10B, 10C and 10D develop the latent images by only the d.c. bias voltage, an alternate bias power supply 54 separately provided at the nondeveloping position can be used to measure the amount of developer during a period of time where other developing devices conduct development. In this case, it is unnecessary to rotate the support member 100 only for detecting the residual amount of the developer.

THIRD EMBODIMENT

Figure 16:
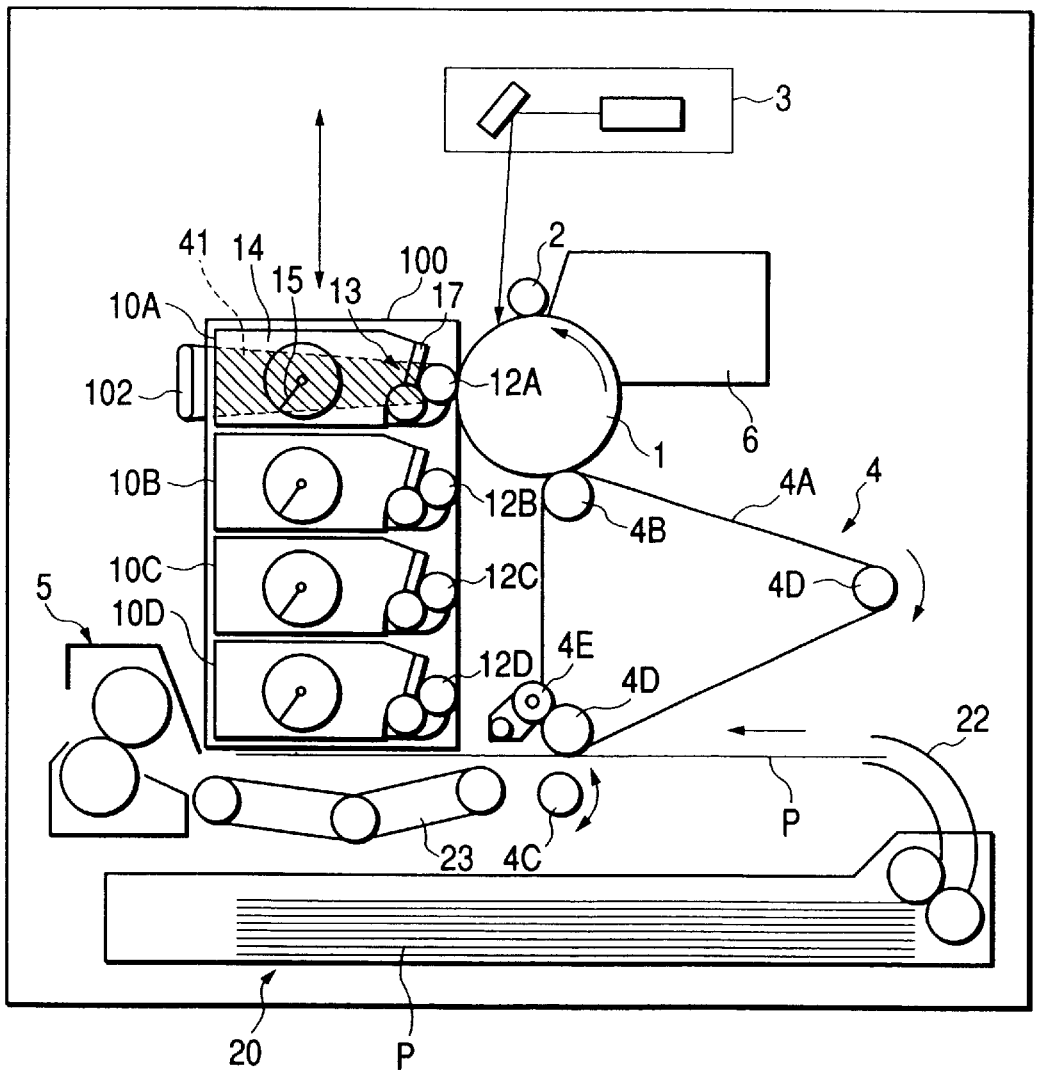
FIG. 16 is a structural diagram showing the outline of an image forming apparatus in accordance with another embodiment of the present invention.

FIG. 16 shows an image forming apparatus in accordance with a third embodiment of the present invention. This embodiment is different from the second embodiment in that the image forming apparatus according to the second embodiment is structured such that the plurality of developing devices 10A, 10B, 10C and 10D each made into a cartridge are mounted on the support member 100 which is rotationally controlled, whereas in this embodiment, a plurality of developing devices each made in a cartridge are mounted on and supported by a support member which is controlled movably in parallel to the vertical direction. Accordingly, members identical in structure and function with those in the second embodiment are designated by the same reference numerals, and their detailed description will be omitted.

Also, in this embodiment, the first electrode of the developer residual amount detecting electrode pairs is formed of one of the developing rollers 12A, 12B, 12C and 12D of the respective developing devices 10A, 10B, 10C and 10D which is disposed at the developing position as in the second embodiment, and the other second electrode 102 is located outside of the support member 100 and mounted on the main body of the image forming apparatus.

When one of the developing rollers 12A, 12B, 12C and 12D of the respective developing devices 10A, 10B, 10C and 10D is moved to be placed opposite to the photosensitive drum 16, that is, when one of the respective developing devices 10A, 10B, 10C and 10D moves at the developing position, the second electrode 102 and the moved developing rollers 12A, 12B, 12C and 12D of the respective developing devices 10A, 10B, 10C and 10D are disposed at positions that satisfy the relationship between the first and second electrodes as described in the first and second embodiments. The electrode 102 is positioned and structured so as not to impede the movement of the developing devices, but disposed at a position as close as possible to the developing device which is moved to the developing position.

According to this embodiment, since the residual amounts of developers of the respective developing devices 10A, 10B, 10C and 10D which have been replaced by the movement of the support member 100 are measured at one position to which the respective developing devices 10A, 10B, 10C and 10D are movable, the respective residual amounts of developers of the plural developing devices 10A, 10B, 10C and 10D are measured independently.

In other words, in this embodiment, the electrode pair 12 (12A, 12B, 12C and 12D) and 102 which are formed of the first and second electrodes are so disposed as to be opposed to each other on a line penetrating the developing portion 13 and the hopper portion 14 of the developing device 10, independently or together, as in the first and second embodiments. Further, the electrode pair 12 (12A, 12B, 12C and 12D) and 102 are disposed in such a manner that a space region 41 (a region indicated by an oblique line in FIG. 16) defined by the electrode pair 12 (12A, 12B, 12C and 12D) and 102 opposed to each other includes substantially 20% or more of the developer T which is filled in the developing portion 13 and the hopper portion 14 in a full state.

In the case where the second electrode 102 is fitted onto the image forming apparatus per se as in this embodiment, since a wiring to the electrode 102 can be designed separately from the movable portion, a signal from the electrode 102 can be extracted directly, which is simple in structure and stable in output as compared with a case in which the signal is extracted through a sliding contact or the like from the interior of the support member 100. As a result, the developer residual amount can be accurately detected with high precision. It is needless to say that the second electrode 102 may be disposed on the respective developer devices per se as described in the first embodiment if desired.

FOURTH EMBODIMENT

Figure 17:
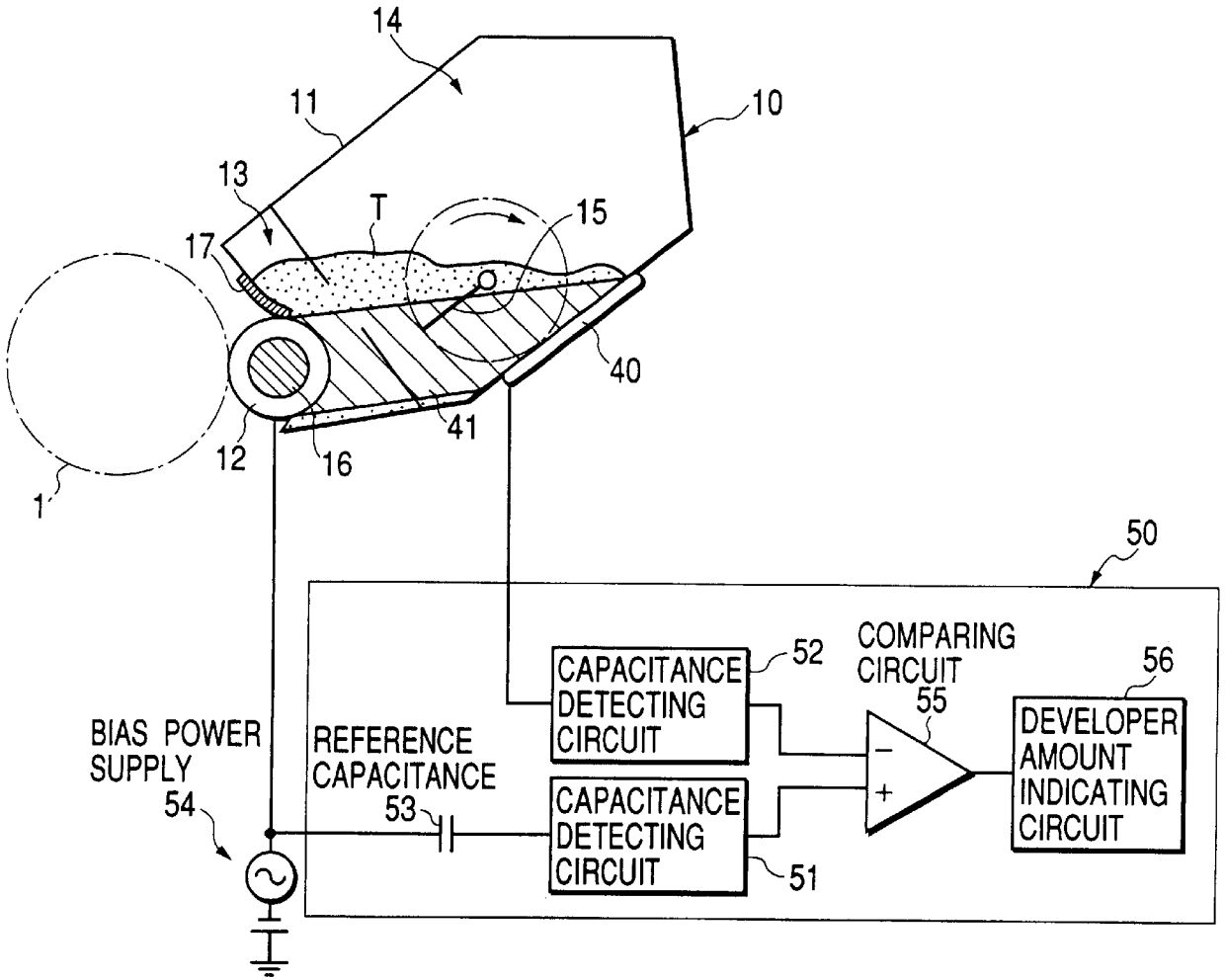
FIG. 17 is a structural diagram showing the outline of a developing device in accordance with an embodiment of the present invention.
Figure 18:
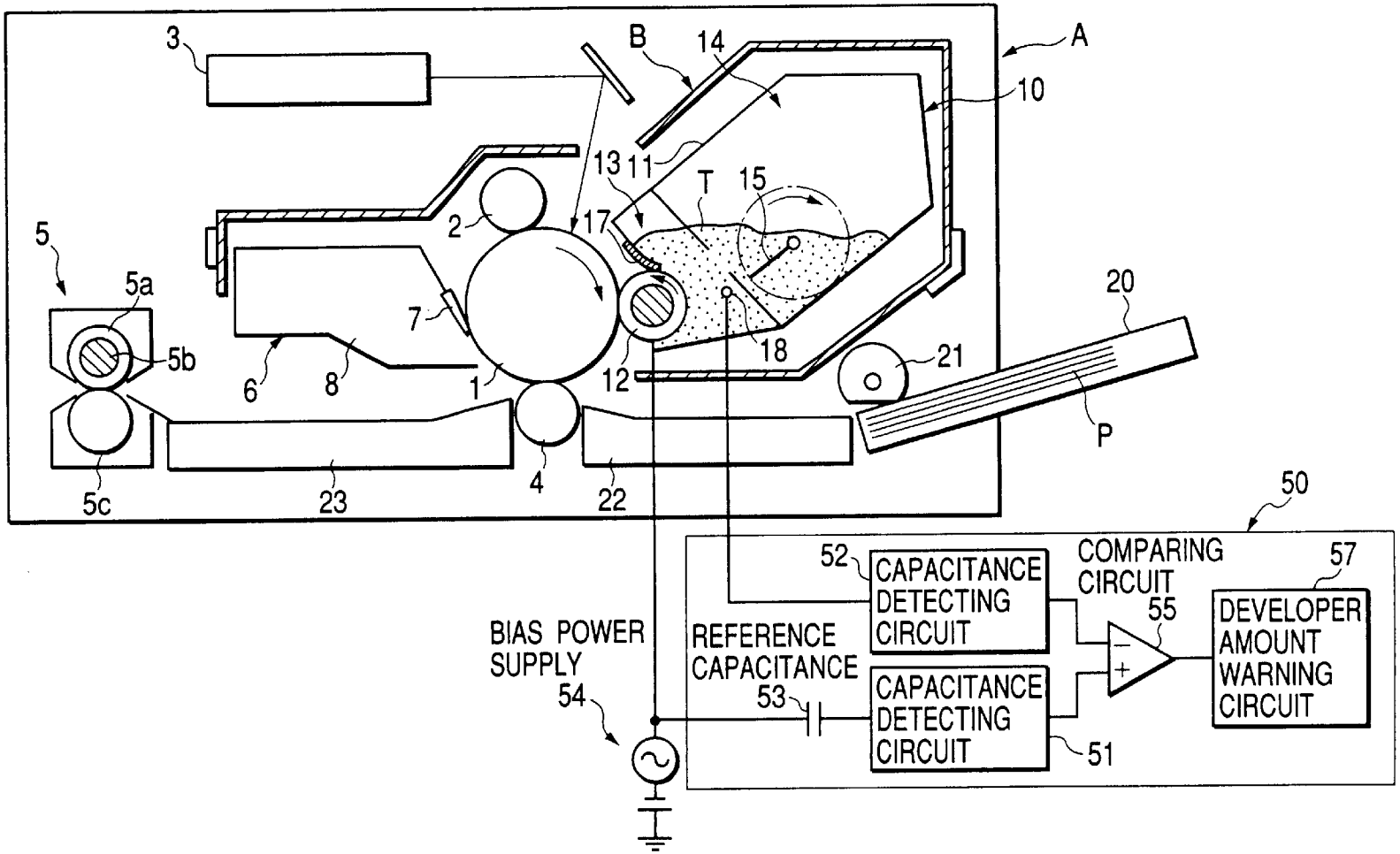
FIG. 18 PRIOR ART
FIG. 18 is a structural diagram showing the outline of a conventional image forming apparatus.

FIG. 17 shows a developing device made into a cartridge in accordance with another embodiment of the present invention.

A developing device 10 according to this embodiment includes a developer bearing member 12 such as a developing roller and a developer container 11 with a developing portion 13 and a hopper portion 14 each having toner therein in order to supply a developer to the developer bearing member 12, and makes those members 12 and 11 integrally into a cartridge. That is, the developing device according to this embodiment makes the developing device structural portion of the process cartridge B described in the first embodiment into a cartridge. That is, the developing device according to this embodiment can be regarded as a cartridge that makes the respective members except for the photosensitive drum 1, the charging means 2 and the cleaning means 6 from the process cartridge B integral. Therefore, all of the developing device structures and the developer amount detecting means structures as described in the first embodiment are applied to the developing device of this embodiment, likewise. Accordingly, the description of those structures and functions is applied to the above description of the first embodiment.

It is needless to say that the same developer residual amount detecting means as that described in the first embodiment is disposed in this embodiment, thereby making it possible to sequentially detect the residual amount of developer with high precision.

The present invention is not limited to the structure in which assuming that the amount of developer contained in the developer container is 100%, the amount of developer is sequentially detected over the entire region of from 100% to 0%. For example, the residual amount of developer within the developer container may be sequentially detected over the region of 50% to 0%. That the residual amount of developer is 0% does not means only that the developer is completely consumed. For example, that the residual amount of developer is 0% includes that the residual amount of developer is reduced to the degree which cannot obtain a given image quality (developing quality) even if the developer remains within the developer container.

As was described above, the developing device, the process cartridge and the electrophotographic image forming apparatus according to the present embodiment are structured in such a manner that, in order to detect the residual amount of developer in the developing device by the main body of the electrophotographic image forming apparatus, there are provided the developer residual amount detecting electrode pair having the first and second electrodes which interpose the developing portion and the hopper portion of the developing device therebetween, the first electrode of the developer residual amount detecting electrode pair is comprised of the developer bearing member, and the second electrode thereof is fitted onto an outer wall of the developer container. With the above structure, a state in which the developer is full to a state immediately before printing becomes defective can be detected accurately, and the residual amount of developer can be detected more inexpensively and accurately.

Also, according to the above-described embodiments, similarly, in the image forming apparatus having a plurality of developing devices, the residual amount of developer in each of the developing devices from a state in which the developer is full to a state immediately before printing becomes defective can be sequentially detected independently, accurately and with an inexpensive structure.

Further, according to the above-described embodiments, in the image forming apparatus having a plurality of developing devices and structured in such a manner that the developing device is replaceable for each printing or for each color of developers contained in the developing devices by rotatable or parallel movable support member, at least one electrode of the developer residual amount detecting electrode pair is disposed at a fixed position, and the residual amount of developer of each the developing device which has been replaced by the movement of the support member, is measured at one position to which each the developing devices is movable. With the above structure, the respective residual amounts of developers of the plural developing devices can be measured with high precision, accurately and inexpensively.

As was described above, according to the present invention, the residual amount of developer can be sequentially detected with high precision.

While the invention has been described with reference to the structures disclosed herein, it is not confined to the details set forth and this application is intended to cover such modifications or changes as may come within the purposes of the improvements or the scope of the following claims.

What is claimed is:

1. An electrophotographic image forming apparatus for forming an image on a recording medium, said electrophotographic image forming apparatus comprising:

(a) an electrophotographic photosensitive member;

(b) electrostatic latent image forming means for forming an electrostatic latent image on said electrophotographic photosensitive member;

(c) a plurality of developing devices each having a developer bearing member for feeding the developer to said electrophotographic photosensitive member, and a hopper portion for containing the developer therein and supplying the developer to said developer bearing member, in order to develop the electrostatic latent image formed on said electrophotographic photosensitive member;

(d) a support member for detachably mounting said plurality of developing devices to move said developing devices to a developing position opposite to said electrophotographic photosensitive member;

(e) first and second electrodes for detecting a residual amount of developer in each of said plurality of developing devices by a main body of the electrophotographic image forming apparatus;

(f) bias voltage applying means for applying a bias voltage to at least said first electrode; and (g) developer amount detecting means for measuring a capacitance between said first and second electrodes to grasp the amount of developer;

wherein said first electrode comprises said developer bearing member of each of said plurality of developing devices, and said second electrode is disposed on an electrode support member independent of said support member.

2. The electrophotographic image forming apparatus according to claim 1, wherein said support member rotates about a rotating axis to move said developing devices to the developing position, and said electrode support member is disposed on said rotating axis independently of said support member.

3. The electrophotographic image forming apparatus according to claim 1, wherein said support member moves said developing devices to the developing position in a parallel moving manner, and said electrode support member comprises said main body of said electrophotographic image forming apparatus.

4. The electrophotographic image forming apparatus as claimed in any one of claims 1, 2 or 3, wherein said second electrode transmits an electric signal that corresponds to a capacitance between said first and second electrodes, which is generated when a voltage is applied to said first electrode, to developer amount detecting means for detecting the residual amount of developer which is disposed on said main body of the electrophotographic image forming apparatus.

5. The electrophotographic image forming apparatus as claimed in any one of claims 1, 2 or 3, wherein said developer bearing member comprises a developing roller.

6. The electrophotographic image forming apparatus as claimed in any one of claims 1, 2 or 3, wherein said bias voltage comprises a developing bias voltage in which a d.c. voltage is superimposed on an a.c. voltage.

7. The electrophotographic image forming apparatus according to claim 5, wherein said second electrode comprises a metal plate member disposed to extend along a longitudinal direction of said developing roller.

8. The electrophotographic image forming apparatus as claimed in any one of claims 1, 2 or 3, wherein said developer amount detecting means includes a reference capacitance which is nearly equal to a minimum value or a maximum value of the capacitance produced between said first and second electrodes and applied with a bias voltage substantially equal to the bias voltage applied between both the electrodes; a capacitance detecting circuit for measuring said reference capacitance; a capacitance detecting circuit for measuring the capacitance between both of said electrodes; and a comparing circuit for comparing the capacitances measured by both of said capacitance detecting circuits with each other.

9. The electrophotographic image forming apparatus according to claim 8, wherein said capacitance detecting circuit for measuring said reference capacitance comprises a plurality of reference capacitances; and reference capacitance switching means for switching the reference capacitance to an optimum reference capacitance depending on said developing device.

10. The electrophotographic image forming apparatus according to claim 1, wherein said plurality of developing devices have a yellow developer, a magenta developer, a cyan developer, and a black developer respectively.

11. A developing device detachably mountable to a main body of an electrophotographic image forming apparatus, said electrophotographic image forming apparatus including a supporting means for supporting a plurality of developing devices for developing electrostatic latent images formed on an electrophotographic photosensitive member to move said plurality of developing devices to a developing position opposite to said electrophotographic photosensitive member and a main body electrode for detecting a residual amount of developer, said developing device comprising:

a developer bearing member for bearing the developer to develop an electrostatic latent image formed on said electrophotographic photosensitive member;

a hopper portion for containing therein the developer with which said developer bearing member develops the electrostatic latent image; and a developing device electrode for forming a capacitance between said main body electrode and said developing device electrode so that the main body of said electrophotographic image forming apparatus detects the residual amount of the developer in said developing device based on a signal corresponding to the capacitance when said developing device supported by said supporting means is moved to the developing position by said supporting means.

12. The developing device according to claim 11, wherein said supporting means supporting said developing device is rotated about a rotating axis to move said developing device to the developing position, and said main body electrode is provided on an electrode supporting member independent of said supporting means so that said main body electrode is disposed on the rotating axis.

13. The developing device according to claim 11, wherein said supporting means supporting said developing device is translated to move said developing device to said developing position.

14. The developing device according to any one of claims 11, 12, or 13, wherein said developer bearing member is a developing roller and said developing roller is said developing device electrode.

15. The developing device according to any one of claims 11, 12, or 13, wherein the developer in a respective one of said plurality of developing devices is one of a yellow developer, a magenta developer, a cyan developer, and a black developer.

16. The developing device according to any one of claims 11, 12, or 13, wherein said main body electrode is a common electrode for creating the capacitance between a plurality of developing device electrodes of said plurality of developing devices and said common electrode.

17. An electrophotographic image forming apparatus to which a plurality of developing devices are detachably mountable for developing electrostatic latent images formed on an electrophotographic photosensitive member, said electrophotographic image forming apparatus comprising:

a main body electrode;

supporting means for supporting said plurality of developing devices to move said plurality of developing devices to a developing position opposite to said electrophotographic photosensitive member, each of said plurality of developing devices comprising:

a developer bearing member for bearing a developer to develop an electrostatic latent image formed on said electrophotographic photosensitive member;

a hopper portion for containing therein the developer with which said developer bearing member develops the electrostatic latent image; and a developing device electrode for forming a capacitance between said main body electrode and said developing device electrode so that a main body of said electrophotographic image forming apparatus detects a residual amount of the developer in a developing device based on a signal corresponding to the capacitance when said developing device supported by said supporting means is moved to said developing position by said supporting means; and detecting means for detecting the residual amount of the developer based on the signal.

18. The electrophotographic image forming apparatus according to claim 17, wherein said supporting means supporting said developing device is rotated about a rotating axis to move said developing device to the developing position, and said main body electrode is provided on an electrode supporting member independent of said supporting means so that said main body electrode is disposed on the rotating axis.

19. The electrophotographic image forming apparatus according to claim 17, wherein said supporting means supporting said developing device is translated to move said developing device to the developing position.

20. The electrophotographic image forming apparatus according to any one of claims 17, 18, or 19, wherein said developer bearing member comprise a developing roller and constitutes said developing device electrode.

21. The electrophotographic image forming apparatus according to any one of claims 17, 18, or 19, wherein the developer in a respective one of said plurality of developing devices is one of a yellow developer, a magenta developer, a cyan developer, and a black developer.

22. The electrophotographic image forming apparatus according to any one of claims 17, 18, or 19, wherein said main body electrode is a common electrode for creating the capacitance between a plurality of developing device electrodes of said plurality of developing devices and said common electrode.

* * * * *

UNITED STATES PATENT AND TRADEMARK OFFICE

CERTIFICATE OF CORRECTION

PATENT NO. : 6,314,250 B1
DATED : November 6, 2001
INVENTOR(S) : Toshiaki Miyashiro It is certified that error appears in the above-identified patent and that said Letters Patent is hereby corrected as shown below:

Column 6,
Line 63, "external" should read -- exterior --.

Column 7,
Line 31, "having" should read -- being --.

Column 9,
Line 67, "becomes lower" should read -- decreases --.

Column 10,
Line 3, "much" should read -- great, --;
Line 19, "of the" should be deleted;
Line 49, "is" (second occurrence) should read -- be --;
Line 53, "is" should read -- be --.

Column 11,
Line 6, "are" should read -- is --.

Column 13,
Line 50, "is" should read -- be --.

Column 14,
Line 9, "in" should be deleted.

Column 15,
Line 41, "means" should read -- mean --.

UNITED STATES PATENT AND TRADEMARK OFFICE

CERTIFICATE OF CORRECTION

PATENT NO. : 6,314,250 B1
DATED : November 6, 2001
INVENTOR(S) : Toshiaki Miyashiro It is certified that error appears in the above-identified patent and that said Letters Patent is hereby corrected as shown below:

Column 16,
Line 59, "developer;" should read -- developer, --.

Column 19,
Line 11, "comprise" should read -- comprises --.

Signed and Sealed this

Twenty-first Day of May, 2002

*Attest:*

*Attesting Officer*

JAMES E. ROGAN
*Director of the United States Patent and Trademark Office*